US009639051B2

(12) United States Patent
Miura et al.

(10) Patent No.: US 9,639,051 B2
(45) Date of Patent: May 2, 2017

(54) POWDER RECOVERY DEVICE AND PROCESSING DEVICE USING THE SAME

(71) Applicant: FUJI XEROX CO., LTD., Tokyo (JP)

(72) Inventors: Go Miura, Kanagawa (JP); Tsutomu Komiyama, Kanagawa (JP); Koyu Shigemori, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 14/988,322

(22) Filed: Jan. 5, 2016

(65) Prior Publication Data

US 2017/0023908 A1 Jan. 26, 2017

(30) Foreign Application Priority Data

Jul. 24, 2015 (JP) ..... 2015-146795

(51) Int. Cl.
*G03G 21/00* (2006.01)
*G03G 21/10* (2006.01)
*G03G 21/12* (2006.01)

(52) U.S. Cl.
CPC ..... *G03G 21/105* (2013.01); *G03G 21/12* (2013.01); *G03G 2221/1624* (2013.01)

(58) Field of Classification Search
CPC ..... G03G 21/10; G03G 21/105; G03G 21/12; G03G 21/206; G03G 2215/1661; G03G 2221/0052; G03G 2221/1624; G03G 2221/1645
USPC ..... 399/92, 93, 101, 120, 360; 222/146.6, 222/DIG. 1
See application file for complete search history.

(56) References Cited

U.S. PATENT DOCUMENTS 7,995,961 B2 * 8/2011 Ichiki ..... G03G 21/12 399/120
2015/0023708 A1 * 1/2015 Lee ..... G03G 21/105 399/358
2016/0026119 A1 * 1/2016 Ohashi ..... G03G 15/095 399/358

FOREIGN PATENT DOCUMENTS

JP 2004-198899 A 7/2004
JP 2008-216278 A 9/2008
JP 2011237529 A * 11/2011

* cited by examiner

*Primary Examiner* — Robert Beatty
(74) *Attorney, Agent, or Firm* — Oliff PLC

(57) ABSTRACT

Provided is a powder recovery device including a recovery container that includes a powder collection chamber therein, recovers used powder transported from a powder processing section that performs a process using powder, and collects the recovered powder in the powder collection chamber, and a transport member that is provided within the recovery container along the longitudinal direction of the recovery container, and evenly transports powder collected in the powder collection chamber, wherein plural recovery ports are provided at positions located higher than a highest location in the recovery container at which powder is collected, and plural air vent ports are at least separately provided at regions with a center of the recovery container in the longitudinal direction of the recovery container interposed therebetween.

20 Claims, 18 Drawing Sheets

POWDER RECOVERY DEVICE AND PROCESSING DEVICE USING THE SAME

CROSS-REFERENCE TO RELATED APPLICATIONS

This application is based on and claims priority under 35 USC 119 from Japanese Patent Application No. 2015-146795 filed Jul. 24, 2015.

BACKGROUND

Technical Field

The present invention relates to a powder recovery device and a processing device using the same.

SUMMARY

According to an aspect of the invention, there is provided a powder recovery device including:

a recovery container that includes a powder collection chamber therein, recovers used powder transported from a powder processing section that performs a process using powder, and collects the recovered powder in the powder collection chamber; and a transport member that is provided within the recovery container along the longitudinal direction of the recovery container, and evenly transports powder collected in the powder collection chamber, wherein plural recovery ports are provided at positions located higher than a highest location in the recovery container at which powder is collected, and recover the used powder transported from the powder processing section, and plural air vent ports are at least separately provided at regions with a center of the recovery container in the longitudinal direction of the recovery container interposed therebetween, are located further upward than the transport member, and are installed at positions deviating from drop paths of powder from the respective recovery ports and at regions which do not exceed a vertical lower-end position of a proximal recovery port.

BRIEF DESCRIPTION OF THE DRAWINGS

Exemplary embodiments of the present invention will be described in detail based on the following figures, wherein.

DETAILED DESCRIPTION

Outline of Exemplary Embodiment

Figure 1:
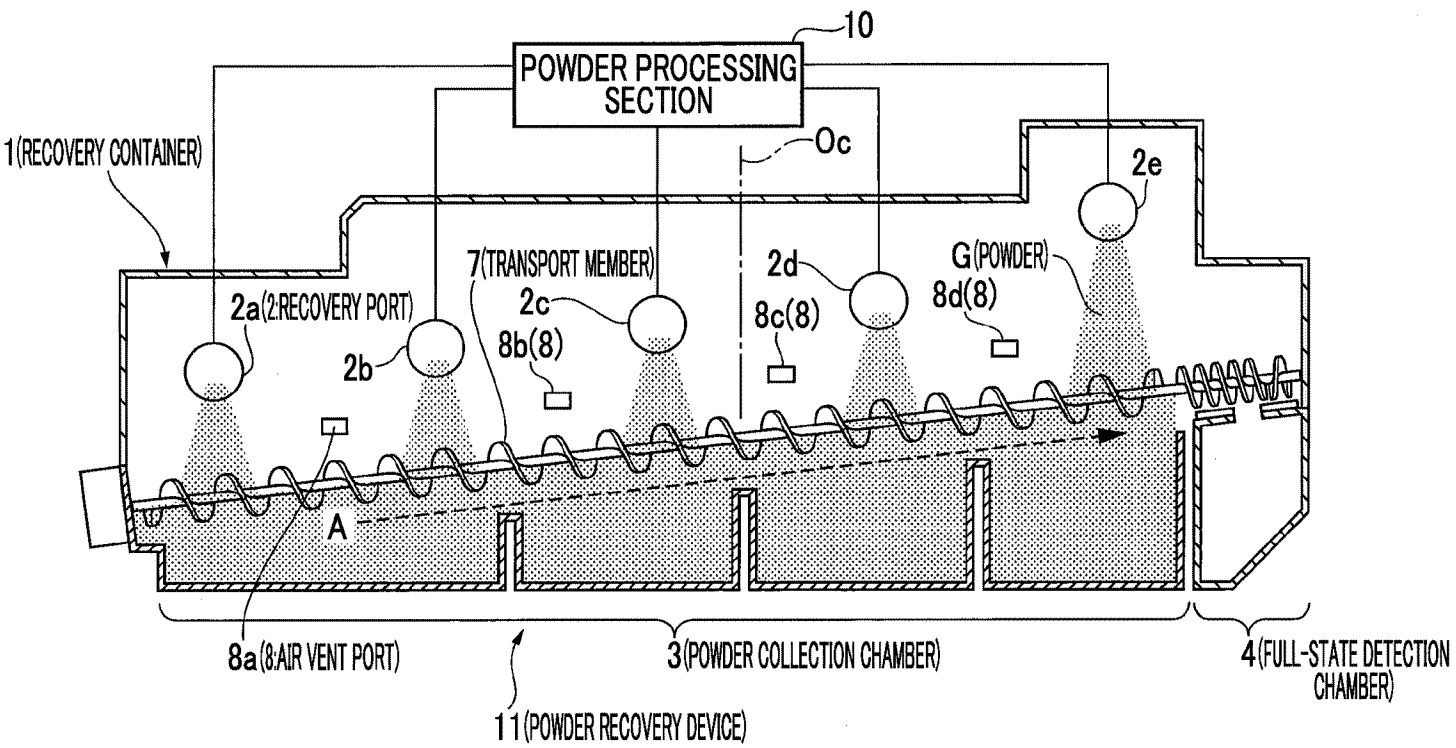
FIG. 1 is a diagram illustrating an outline of an exemplary embodiment of a processing device including a powder recovery device to which the present invention is applied.

FIG. 1 shows an outline of an exemplary embodiment of a processing device including a powder recovery device to which the present invention is applied.

In the same drawing, the processing device includes a powder processing section 10 that performs a process using powder G, and a powder recovery device 11 that recovers the powder G transported from the powder processing section 10.

Here, the powder processing section 10 widely includes those used in performing a process using the powder G, and the powder recovery device 11 widely includes those used in recovering the powder G used in the powder processing section 10.

For example, in the processing device using developer as powder, the powder processing section 10 includes an image holding member capable of holding an electrostatic latent image, a developing device that develops an electrostatic latent image formed on the image holding member with developer as powder, a transfer device that transfers a visible image developed by the developing device to a recording material, and a cleaning device that cleans developer remaining on the image holding member, and the powder recovery device 11 recovers developer as powder which is transported from at least one of the cleaning device, the transfer device and the developing device. In the present example, the cleaning device targets cleaned developer as a recover object. In addition, when the transfer device is, for example, an intermediate transfer-type transfer device, developer cleaned by a cleaning device of an intermediate transfer body is targeted as a recover object. In addition, even when a direct transfer-type transfer device is used, developer cleaned by a cleaning device added to a transfer member is targeted as a recover object. Further, in the developing device, for example, two-component developer containing toner and carrier is used, the toner is consumed, but the carrier is not consumed. Therefore, when the developer itself becomes older, there may be a concern of charging characteristics or the like becoming defective, and thus old developer is targeted as a recover object.

In the present exemplary embodiment, the powder recovery device 11 includes a recovery container 1, including a powder collection chamber 3 therein, which recovers used powder G transported from the powder processing section 10 that performs a process using powder G and collects the recovered powder in the powder collection chamber 3, plural recovery ports 2 (2*a* to 2*e* in the present example), separately provided at positions located higher than a highest location in the recovery container 1 at which powder is collected and at positions divided into plural regions along the longitudinal direction of the recovery container 1, which recover the used powder G transported from the powder processing section 10, a transport member 7, provided within the recovery container 1 along the longitudinal direction of the recovery container 1, which evenly transports powder G collected in the powder collection chamber 3 in the direction of arrow A in FIG. 1, and plural air vent ports 8 (8*a* to 8*d* in the present example) which are at least separately provided at regions with a center Oc of the recovery container 1 in the longitudinal direction of the recovery container 1 interposed therebetween, are located further upward than the transport member 7, and are installed at positions deviating from drop paths of the powder G from the respective recovery ports 2 and at regions which do not exceed at least one vertical lower-end position of a proximal recovery port 2.

Meanwhile, in FIG. 1, sign 4 refers to a full-state detection chamber, provided adjacent to the powder collection chamber 3, which collects powder G overflowing from the powder collection chamber 3 and detects whether the powder G collected in the powder collection chamber 3 reaches a full-state.

In such technical means, the recovery container 1 is a container that recovers the powder G transported from the powder processing section 10, and collects the powder collection chamber 3 provided inside. Meanwhile, as shown in FIG. 1, the full-state detection chamber 4 is provided adjacent to the powder collection chamber 3, but it is necessary to note that, for example, a cover member is provided so that the powder G recovered from the recovery ports 2 (2*a* to 2*e*) does not drop directly to the full-state detection chamber 4, or the like.

Multi-system used powder G is transported from the powder processing section 10, and the recovery container 1 has the plural recovery ports 2 (2*a* to 2*e* in the present example) installed therein in order to recover the powder G. Here, the plural recovery ports 2 are required to be located higher than a highest location in the recovery container 1 at which powder is collected so that the recovered powder G is not deposited up to regions facing the recovery ports 2. In addition thereto, plural powder collection chambers 3 are required to be separately provided at positions divided into plural regions along the longitudinal direction of the recovery container 1 so that the recovered powder G is dispersedly collected throughout approximately the entire area of the recovery container 1.

In addition, the transport member 7 is not limited to an aspect in which a spiral blade is provided in the vicinity of a rotating shaft insofar as powder is transported in a predetermined direction, and a spiral coil, a paddle inclined in an oblique direction, or the like is allowed to be appropriately selected. Meanwhile, in an aspect in which the full-state detection chamber 4 is provided adjacent to the powder collection chamber 3, the transport member 7 may transport the powder G toward the full-state detection chamber 4.

In addition, a layout of the air vent ports 8 (8*a* to 8*d* in the present example) is required to satisfy the following requirements.

(1) From the point of approximately equally suppressing an increase in internal pressure within the recovery container 1 throughout the entire area, the air vent ports are required to be separately provided at regions with the center Oc in the longitudinal direction of the recovery container 1 interposed therebetween. For example, in an aspect in which the air vent ports 8 are biasedly provided at one-sided regions with the center Oc in the longitudinal direction of the recovery container 1 interposed therebetween, there may be a concern of an increase in internal pressure at regions in which the air vent ports 8 are not provided.

(2) When the recovered powder G reaches a region facing the air vent port 8, there may be a concern of the air vent port 8 being clogged, and thus the air vent port 8 is required to be located further upward than the transport member 7.

(3) The air vent port 8 is required to be provided at a region other than the region facing a drop path of the powder G recovered from the recovery port 2 so that the recovered powder G does not infiltrate directly into the air vent port 8.

(4) The powder G within the recovery container 1 moves on an airflow directed to the air vent port 8 as a cloud due to an increase in internal pressure, but the presence of the recovery port 2 in a passing region of this airflow causes a concern of the powder G being attached to the recovery port 2, and thus the air vent port 8 is required to be provided at a region which does not exceed at least one vertical lower-end position of a proximal recovery port 2. Here, a region which does not exceed the vertical lower-end position is preferable with respect to all the proximal recovery ports 2, but the attachment of the powder G to the recovery port 2 is at least effectively suppressed by satisfying this requirement with respect to at least one recovery port 2.

Figure 2A:
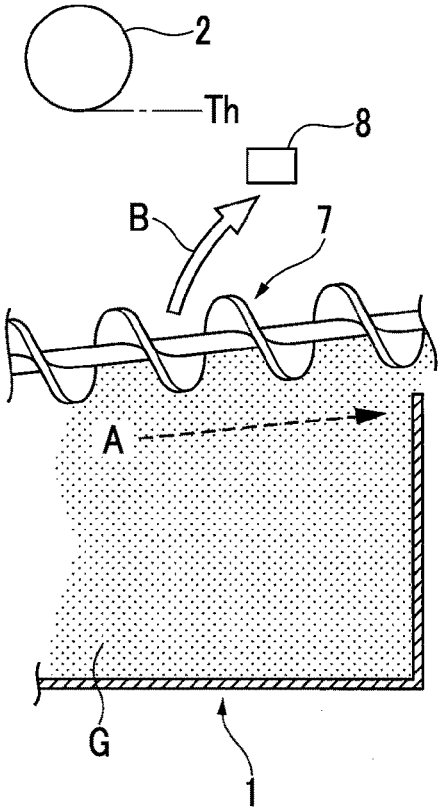
FIG. 2A is a diagram schematically illustrating an air vent action of the powder recovery device according to the exemplary embodiment.

In this manner, in the present exemplary embodiment, as shown in FIGS. 1 and 2A, the air vent ports 8 (8*a* to 8*d*) are separately provided at regions with the center Oc in the longitudinal direction of the recovery container 1 interposed therebetween so as to be the same as each other in number in the present example, air vent effects due to the air vent ports act approximately equally throughout approximately the entire area in the longitudinal direction of the recovery container 1.

In addition, in the present exemplary embodiment, the air vent port 8 is not disposed at a drop path of the powder G from a proximal recovery port 2, and thus there may be little concern of the powder G during drop infiltrating directly into the air vent port 8.

Further, in the present exemplary embodiment, the air vent port 8 is located further upward than the transport member 7, and is disposed at a region which does not exceed a vertical lower-end position Th of the proximal recovery port 2. For this reason, as shown in FIG. 2A, when the powder G collected in the powder collection chamber 3 is evenly transported by the transport member 7, an airflow B directed to the air vent port 8 is generated in association with an increase in internal pressure within the recovery container 1. In this case, when the air is vented from the air vent port 8, an increase in internal pressure within the recovery container 1 is suppressed to that extent. In this state, the powder G floats within the recovery container 1 in a cloud shape, and is directed to the air vent port 8 along with the above-mentioned airflow B. However, when the air vent port 8 is provided with a filter member that captures powder, or the like, a situation in which cloud-shaped powder G is vented from the air vent port 8 is effectively avoided. Further, in the present exemplary embodiment, the passing path of the airflow B directed to the air vent port 8 does not traverse the recovery port 2, and thus there may also be little concern of the cloud-shaped powder G moving along with the airflow B being attached to the recovery port 2.

Figure 2B:
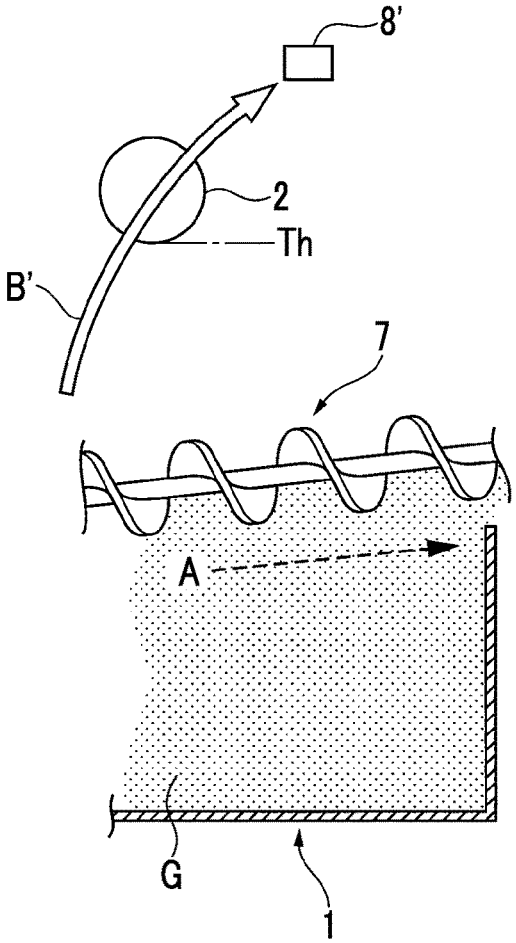
FIG. 2B is a diagram schematically illustrating an air vent action of a powder recovery device according to a comparative example.

On the other hand, as shown in FIG. 2B, in an aspect in which an air vent port 8' is provided upward in excess of the vertical lower-end position Th of the recovery port 2 (for example, aspect in which the air vent port is provided further upward than the recovery port 2), an airflow B' directed to the air vent port 8 is generated in association with an increase in internal pressure within the recovery container 1. In this state, the airflow B' directed to the air vent port 8' has a high possibility of traversing a recovery port 2' in the middle of the passing path, and thus there may be a concern of the cloud-shaped powder G moving with the airflow B being attached to the recovery port 2, as compared to the exemplary embodiment shown in FIG. 2A. For this reason, there may be a concern of powder being mixed into, for example, an opening and closing mechanism of a powder discharge device capable of being connected to the powder recovery device 11 or an opening and closing mechanism that opens and closes the recovery port 2, it may be understood that a defective opening and closing operation of each opening and closing mechanism has a tendency to be caused.

Next, a description will be given of a representative aspect or a preferable aspect of the powder recovery device or the processing device according to the present exemplary embodiment.

The representative aspect of the air vent port 8 includes an aspect in which the air vent ports 8 having the same number are provided at regions with the center Oc in the longitudinal direction of the recovery container 1 interposed therebetween. The number of air vent ports 8 is allowed to be appropriately selected, but is satisfied by being the same as or less than the number of recovery ports 2 lined up in the longitudinal direction of the recovery container 1. In an aspect in which the above number is the same as the number of recovery ports 2, it is possible to select the air vent ports 8 in a relationship between the respective recovery ports 2. However, in an aspect in which the above number is less than the same number, an air vent port 8 common to, for example, proper places adjacent to plural recovery ports 2 may be selected.

In addition, the preferable aspect of the air vent port 8 includes an aspect in which the air vent ports are disposed at regions with the center Oc in the longitudinal direction of the recovery container 1 interposed therebetween so as to be the same as each other in number. The present aspect is preferable, in that air vent ports 8 (air vent ports 8*a* and 8*b* and air vent ports 8*c* and 8*d* in the present example) having the same number are provided at regions with the center Oc in the longitudinal direction of the recovery container 1 interposed therebetween, balances of air vent effects within the recovery container 1 are thus set to be approximately the same as each other at regions with the center Oc interposed therebetween, thereby allowing the generation of an unnecessary airflow extending between regions with the center Oc of the recovery container 1 interposed therebetween to be suppressed.

Further, another preferable aspect of the air vent port 8 includes an aspect in which the air vent ports are disposed so as to be displaced from installed positions of the recovery ports 2 in a width direction intersecting the longitudinal direction of the recovery container 1. In the present aspect, a positional relationship between the generation path of an airflow directed to the air vent port 8 and the recovery port 2 is cut off.

Further, another preferable aspect of the air vent port 8 includes an aspect in which an opening is provided in a portion of the recovery container 1, and the opening is covered with an air-permeable filter member capable of capturing the powder G. In the present aspect, since the filter member has a function of capturing the powder G, a structure is obtained in which only the air is vented from the air vent port 8 in a state where the powder G is captured.

In addition, the representative aspect of the recovery port 2 includes an aspect in which the recovery port has a powder discharge portion that discharges the powder G transported from the powder processing section 10 connected thereto, and is sealed with an openable and closable sealing member (not shown) during non-connection of the powder discharge portion. In the present aspect, the recovery container 1 is configured such that the recovery port 2 is sealed with the sealing member during non-connection to the powder discharge portion, and it is possible to prevent the powder G recovered to the recovery container 1 from leaking.

(First Exemplary Embodiment)

Hereinafter, the present invention will be described in more detail with reference to an exemplary embodiment shown in the accompanying drawings.

Entire Configuration of Image Forming Apparatus

Figure 3:
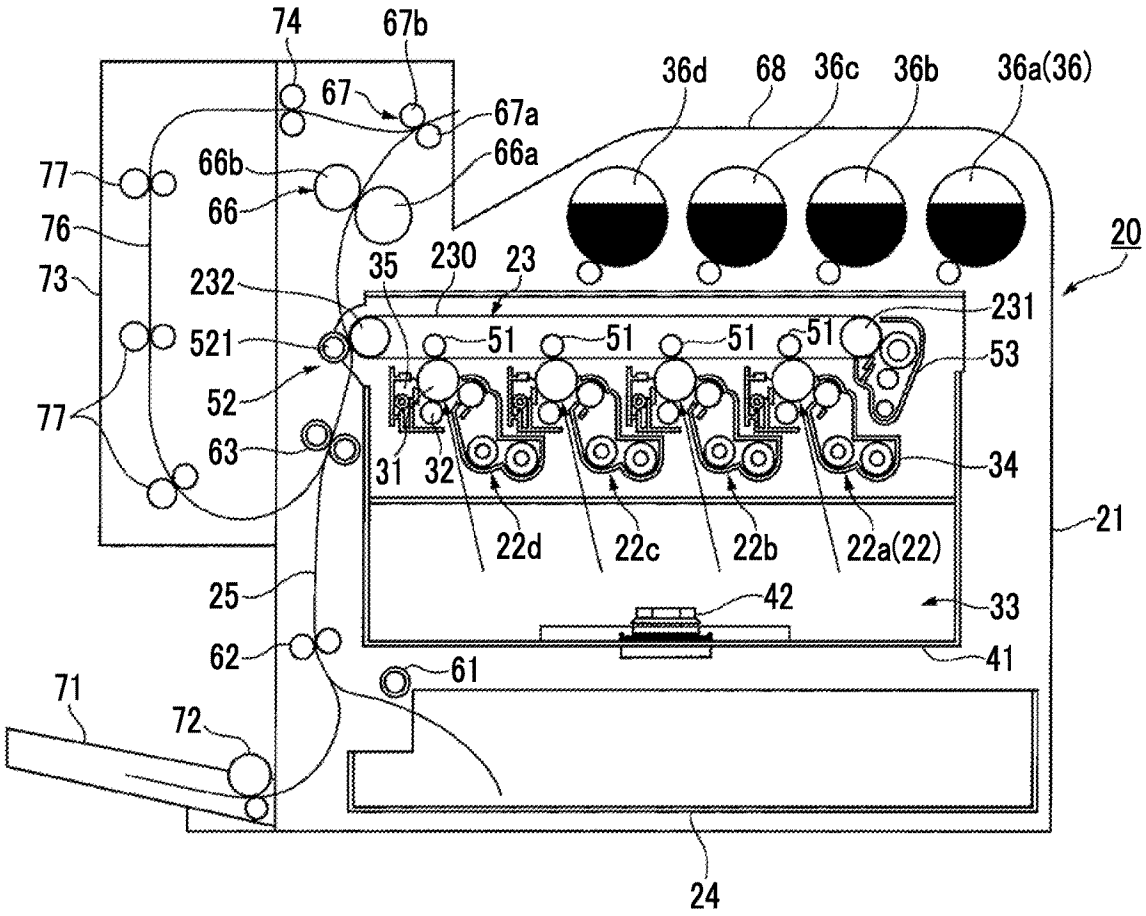
FIG. 3 is a diagram illustrating the entire configuration of an image forming apparatus as a processing device according to a first exemplary embodiment.

FIG. 3 is a diagram illustrating a first exemplary embodiment of an image forming apparatus as the processing device to which the present invention is applied.

In the same drawing, an image forming apparatus 20 is configured such that image forming portions 22 (specifically, 22*a* to 22*d*) of four colors (black, yellow, magenta, and cyan in the present exemplary embodiment) are arrayed within a device housing 21 in a lateral direction, and a transfer module 23 including an intermediate transfer belt 230 circulatively transported along the array direction of each image forming portion 22 is arranged thereon, while a recording material supply device 24 having recording materials such as paper collected therein is arranged below the device housing 21, and a recording material transport path 25 from the recording material supply device 24 is disposed approximately vertically.

In the present exemplary embodiment, each of the image forming portions 22 (22*a* to 22*d*) is used in forming toner images of, for example, black, yellow, magenta, and cyan (which are not necessarily arrayed in this order) in order from the upstream side of the intermediate transfer belt 230 in a circulative direction, and includes a photoconductor 31, a charging device (charging roll in the present example) 32 that charges the photoconductor 31 in advance, an exposure device 33 (in the present example, an exposure device common to the respective image forming portions 22 is used) that writes an electrostatic latent image on each photoconductor 31 charged by the charging device 32, a developing device 34 that develops an electrostatic latent image formed on the photoconductor 31 with corresponding color toner (having, for example, a negative polarity in the present exemplary embodiment), and a cleaning device 35 that cleans residues on the photoconductor 31.

Meanwhile, in the present exemplary embodiment, as shown in FIGS. 2A and 2B, each of the image forming portions 22 is configured as a process cartridge in which the photoconductor 31, the charging device 32, the developing device 34 and the cleaning device 35 are integrated with each other, and is mounted so as to be attachable and detachable to and from an assembly bearing, not shown, of the device housing 21.

Here, the exposure device 33 is configured to stores, for example, four semiconductor lasers (not shown), one polygon mirror 42, an imaging lens (not shown) and each mirror (not shown) corresponding to each photoconductor, within an exposure housing 41, to deflectively scan the polygon mirror 42 with light from a semiconductor laser of each color component, and to guide a light image to an exposure point on a corresponding photoconductor 31 through the imaging lens and the mirror.

Meanwhile, sign 36 (36*a* to 36*d*) refers to a toner cartridge for replenishing each color component toner to each developing device 34.

In addition, in the present exemplary embodiment, the transfer module 23 has the intermediate transfer belt 230 extended between, for example, a pair of tension rolls (one of them is a driving roll) 231 and 232, and is configured such that a primary transfer device (primary transfer roll in the present example) 51 is arranged on the back surface of the intermediate transfer belt 230 corresponding to the photoconductor 31 of each image forming portion 22, and that a toner image on the photoconductor 31 is electrostatically transferred to the intermediate transfer belt 230 side by applying a voltage having a polarity opposite to the charging polarity of toner to the primary transfer device 51.

Further, a secondary transfer device 52 is arranged at a region corresponding to the tension roll 232 of the intermediate transfer belt 230 on the downstream side of the lowermost stream image forming portion 22*d*, and a primary transfer image on the intermediate transfer belt 230 is secondarily transferred (collectively transferred) to a recording material.

In the present exemplary embodiment, the secondary transfer device 52 includes a secondary transfer roll 521 which is disposed on the toner image holding surface side of the intermediate transfer belt 230 in a press-contact state, and a backup roll (serving as the tension roll 232 in the present example), disposed on the backside of the intermediate transfer belt 230, which forms a counter electrode of the secondary transfer roll 521.

For example, the secondary transfer roll 521 is grounded, and a bias having the same polarity as the charging polarity of toner is applied to the backup roll (tension roll 232).

Further, a belt cleaning device 53 is arranged on the upstream side of the uppermost stream image forming portion 22*a* of the intermediate transfer belt 230, and is configured to remove residual toner on the intermediate transfer belt 230.

In addition, the recording material supply device 24 is provided with a supply roll 61 that supplies a recording material, a transport roller 62 that transports a recording material is arranged immediately after the supply roll 61, and a positioning roll (registration roll) 63 that supplies a recording material to a secondary transfer region at a predetermined timing is arranged at the recording material transport path 25 located immediately before the secondary transfer region.

On the other hand, a fixing device 66 is provided at the recording material transport path 25 located on the downstream side of the secondary transfer region. As shown in FIG. 3, the fixing device 66 includes a heating and fixing roll 66*a* having a heater, not shown, built-in and a pressing and fixing roll 66*b*, disposed at this roll in a press-contact state, which rotates following the roll. In addition, a recording material discharge device 67 is provided on the downstream side of the fixing device 66. The recording material discharge device 67 is constituted by paired discharge rolls 67*a* and 67*b* that discharge a recording material within the device housing 21, and is configured to interposably transport and discharge a recording material, and to collect the recording material in a recording material collecting member 68 formed at the upper portion of the device housing 21.

Further, in the present exemplary embodiment, a manual supply device (MSI) 71 is provided laterally of the device housing 21, and a recording material on the manual supply device 71 is supplied toward the recording material transport path 25 by a supply roll 72.

Further, a duplex recording module 73 is attached to the device housing 21. The duplex recording module 73 reverses the recording material discharge device 67 during the selection of a both-sides mode in which image recording is performed on both sides of a recording material, takes up a recording material on which one-sided recording is performed into the inside through a guide roll 74 in front of an inlet, transports a recording material along an inner recording material returning transport path 76 through a proper number of transport rollers 77, and supplies the recording material to the positioning roll 63 side again.

Developer Recovery Device

Figure 4:
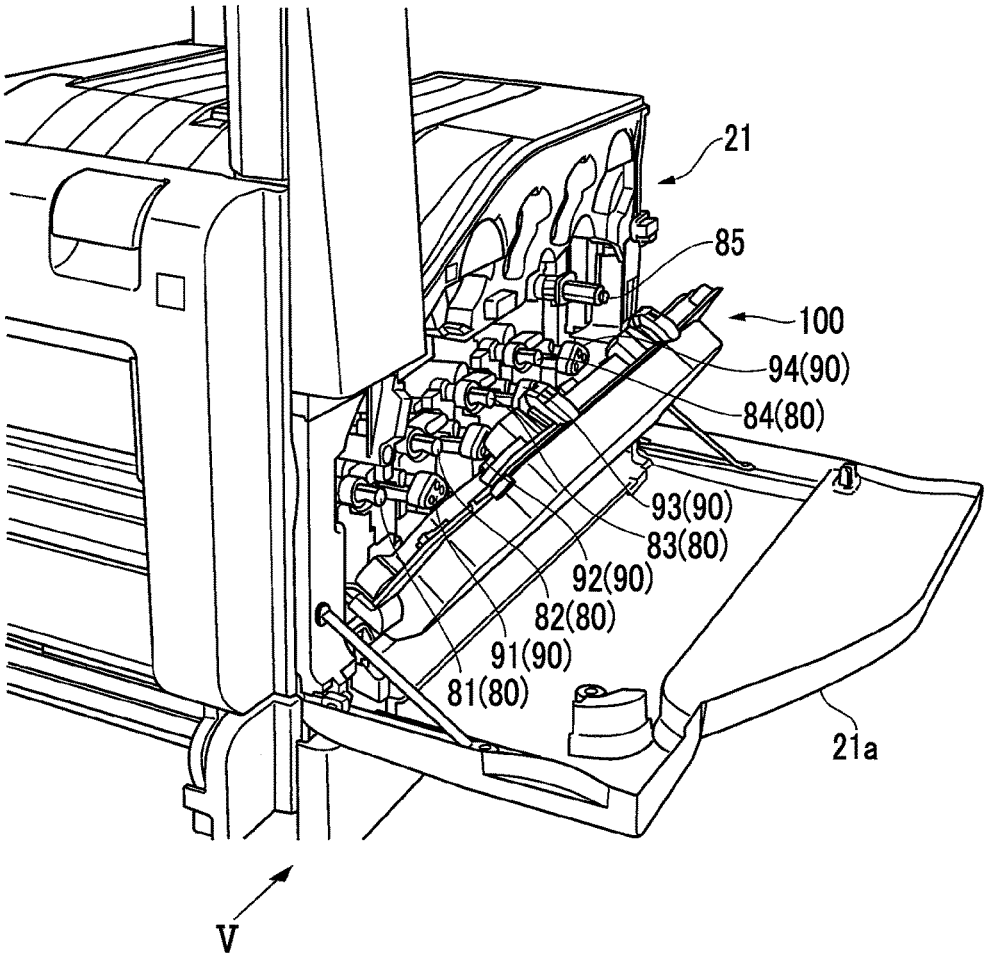
FIG. 4 is a diagram illustrating a state where a developer recovery device is assembled in an image forming apparatus according to the first exemplary embodiment.
Figure 5:
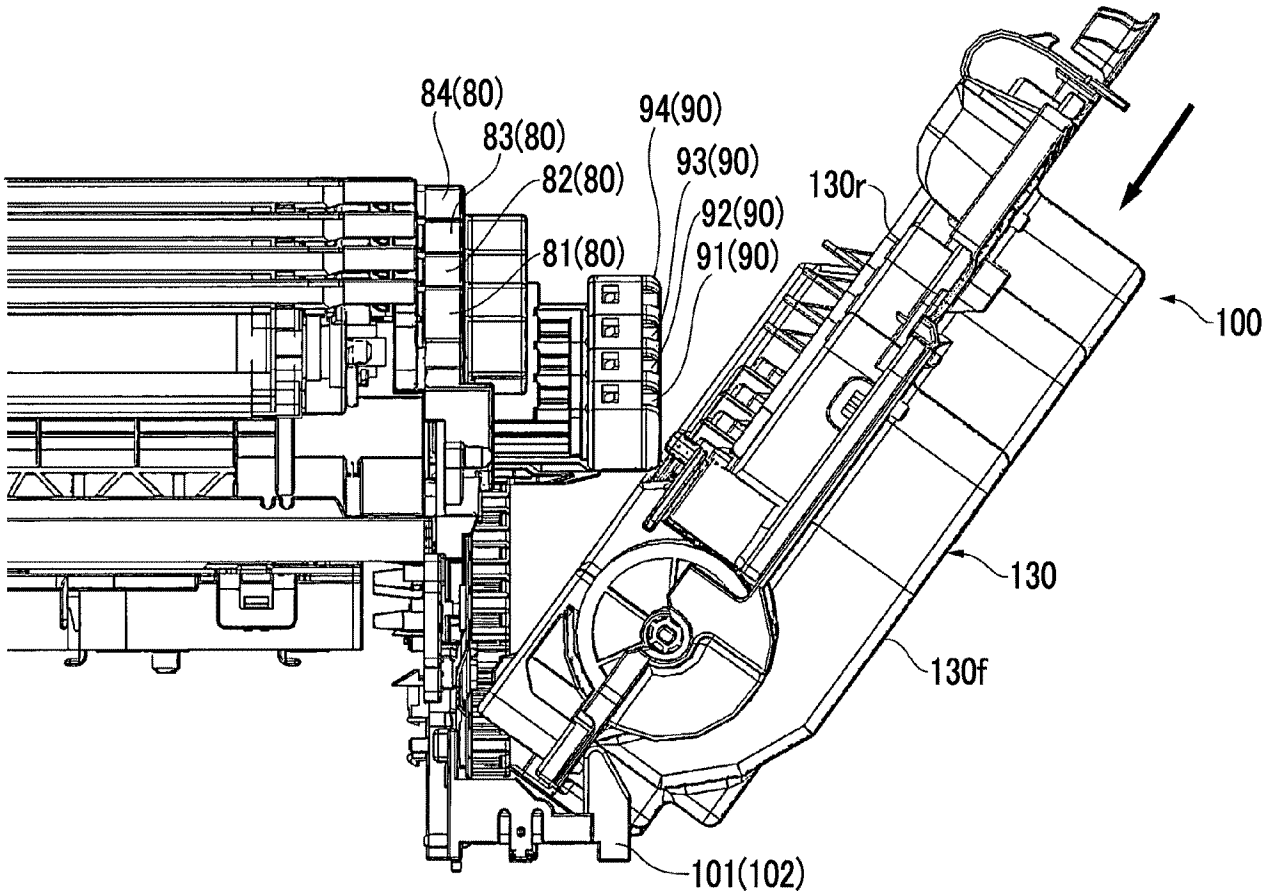
FIG. 5 is a diagram viewed from an arrow in a direction V of FIG. 4.

In the present exemplary embodiment, as shown in FIGS. 4 and 5, a front cover 21*a* of the device housing 21 is opened, and thus a developer recovery device 100 that recovers used developer (waste toner, waste developer) is assembled on the front side of the device housing 21, as a powder recovery device.

In the present example, hinge components 101 and 102 are installed on the front side of the bottom of the device housing 21 on the right and left when viewed from this side, and the developer recovery device 100 is incorporated on the front side of the device housing 21 by rotational movement in a state where the device is supported by the hinge components 101 and 102.

In the present exemplary embodiment, developer as powder which is recovered to the developer recovery device 100 is two-component developer containing toner and carrier, and those transported from the following three systems are targeted.

(1) The cleaning device 35 of each of the image forming portions 22 (22*a* to 22*d*) cleans developer (waste toner) remaining on the photoconductor 31, but the cleaned waste toner is discharged from one end of the cleaning container by a transport member located inside of the cleaning device 35, and is recovered to the developer recovery device 100 through waste toner discharge devices 80 (specifically, 81 to 84), as shown in FIGS. 3 to 5.

(2) The belt cleaning device 53 cleans the developer (waste toner) remaining on the intermediate transfer belt 230, but the cleaned waste toner is discharged from one end of a belt cleaning container by a transport member located inside of the belt cleaning device 53, and is recovered to the developer recovery device 100 through a waste toner discharge device 85, as shown in FIGS. 3 to 5.

(3) The developing device 34 of each of the image forming portions 22 (22*a* to 22*d*) is configured such that a developing roll is arranged within a developing container, and that, for example, plural stirring transport members that charge developer while stirring and mixing the developer are arranged within the developing container, but the carrier of developer remains without being consumed. Therefore, when the carrier of developer becomes older, there may be a concern of having an influence on the charging characteristics of developer. For this reason, in the present example, old developer (waste developer) is discarded periodically from the developing container, and then is recovered to the developer recovery device 100 through waste developer discharge devices 90 (specifically, 91 to 94), as shown in FIGS. 3 to 5.

Configuration of Developer Recovery Device

Figure 6:
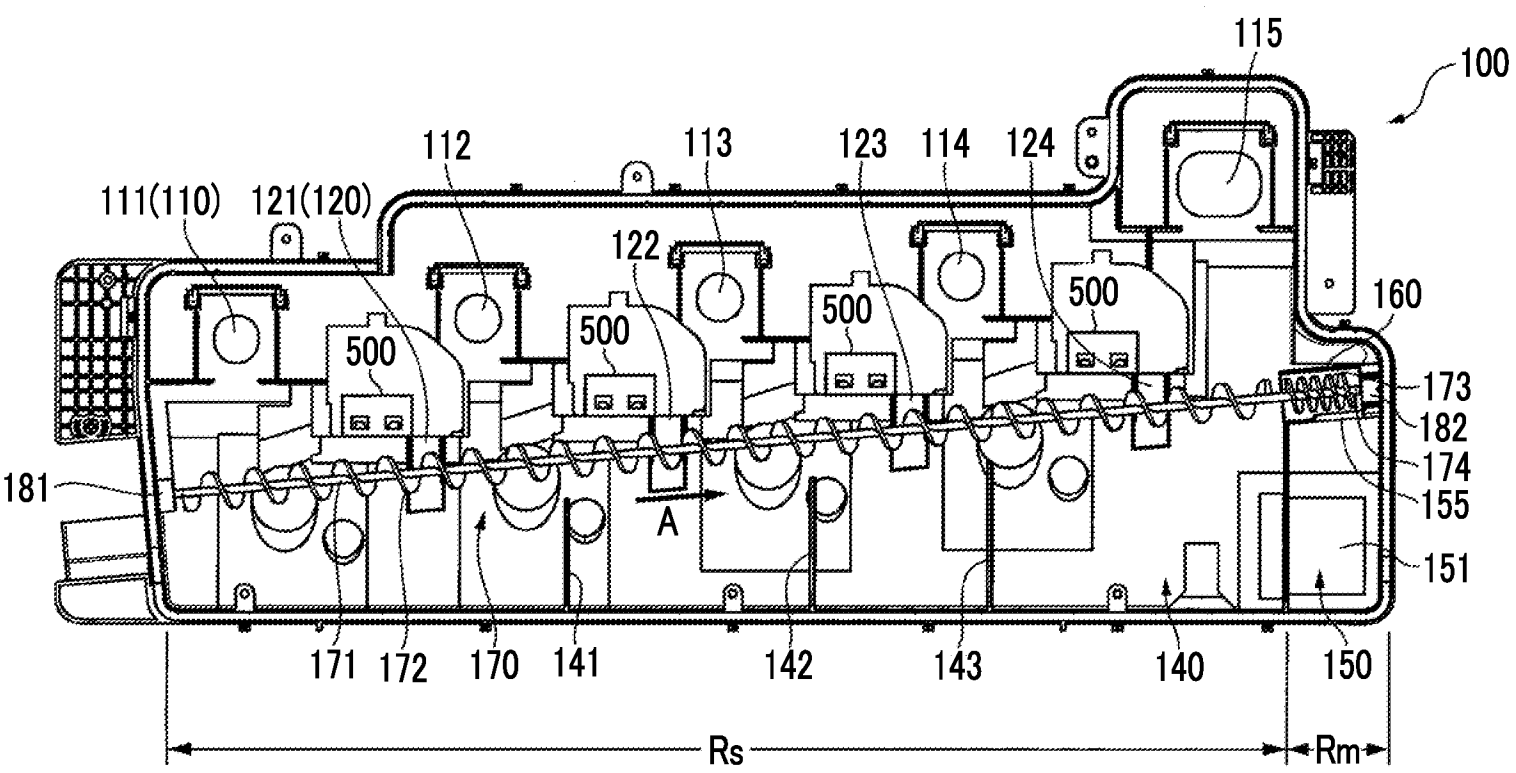
FIG. 6 is a diagram when the entire configuration of the developer recovery device used in the first exemplary embodiment is viewed from the inner side.

In addition, as shown in FIGS. 5 and 6, the developer recovery device 100 includes a recovery container 130 to which the aforementioned three-system developer is recovered. The recovery container 130 is configured such that a front case 130*f* located on the front side of the device housing 21 and a rear case 130*r* located on the back side of the front case 130*f* are formed integrally with each other, and that a storage space of the waste developer is secured therein.

Hereinafter, a description will be mainly given of the rear case 130*r* obtained by removing the front case 130*f* in FIGS. 6 and 7 after the internal structure of the recovery container 130 is made easy to see.

Recovery Port

In the present example, recovery ports 110 (specifically, 111 to 114) to which the waste toner discharge devices 80 (specifically, 81 to 84) are capable of being connected, a recovery port 115 to which the waste toner discharge device 85 is capable of being connected, and recovery ports 120 (specifically, 121 to 124) to which the waste developer discharge devices 90 (specifically, 91 to 94) are capable of being connected are open-installed on the rear case 130*r* of the recovery container 130.

Among these recovery ports 110 (specifically, 111 to 114), 115, and 120 (specifically, 121 to 124), a recovery port located on the leftmost end in the drawing in the horizontal direction of a vertical-wall point of the recovery container 130 is the recovery port 111 which is connected to the waste toner discharge device 81 corresponding to the cleaning device 35 of the image forming portion 22*a* of a black color, a recovery port located on the rightmost end in the drawing is the recovery port 115 which is connected to the waste toner discharge device 85 corresponding to the belt cleaning device 53, and other recovery ports 112 to 114 and 120 (specifically, 121 to 124) are disposed within a region between the recovery port 111 on the leftmost end and the recovery port 115 on the rightmost end in the plane direction of the recovery container 130.

Developer Collection Chamber and Full-state Detection Chamber

Figure 7:
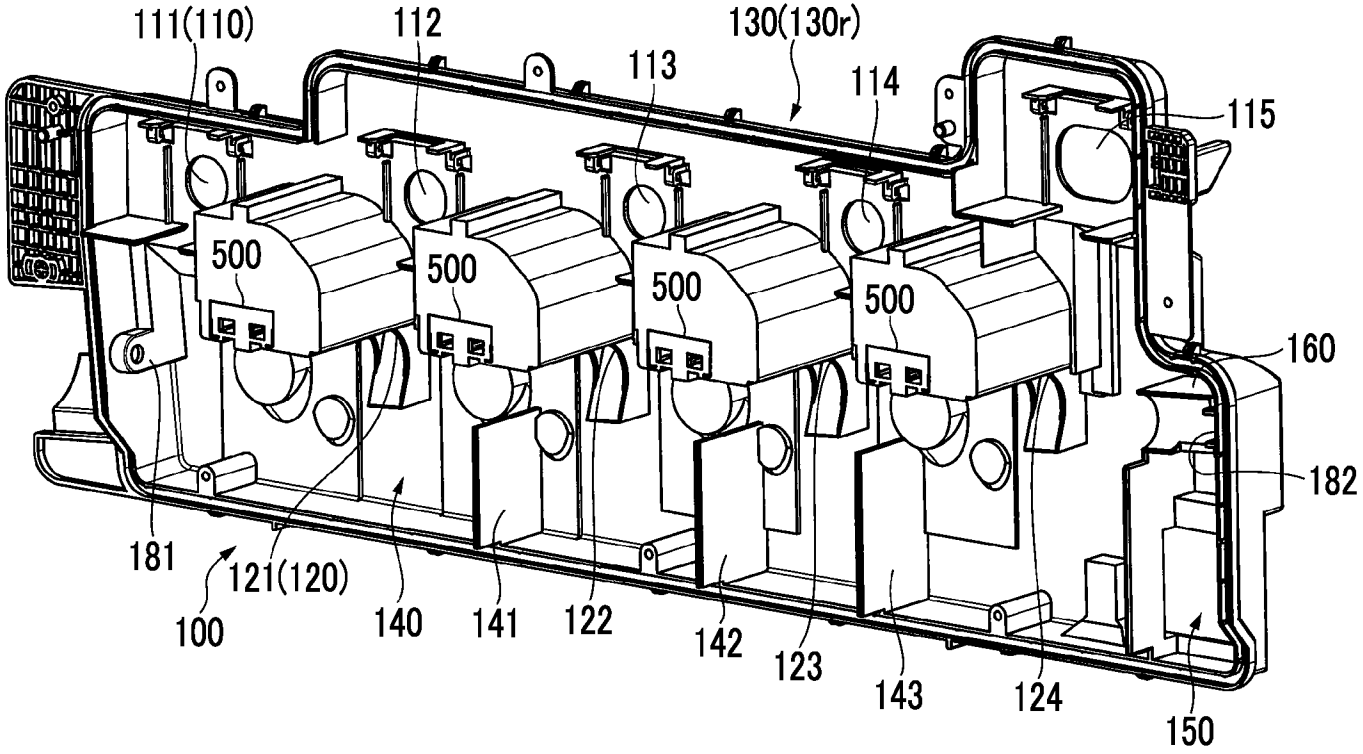
FIG. 7 is a perspective view when a recovery container of the developer recovery device used in the first exemplary embodiment is viewed from the inner side.

In the present example, as shown in FIGS. 6 and 7, the recovery container 130 includes a developer collection chamber 140 that initially collects developer (not shown) recovered from each of the recovery ports 110 (specifically, 111 to 114), 115 and 120 (specifically, 121 to 124), and a full-state detection chamber 150, provided adjacent to the developer collection chamber 140, which collects developer overflowing from the developer collection chamber 140.

In the present example, the full-state detection chamber 150 is provided on one end side in the horizontal direction of the vertical-wall point of the recovery container 130, and other regions are allocated as the developer collection chamber 140.

Further, the developer collection chamber 140 is provided with plural partition walls 141 to 143 in the horizontal direction of the vertical-wall point of the recovery container 130. In the present example, each of the partition walls 141 to 143 is set so that the height dimension thereof gradually increases toward the full-state detection chamber 150.

On the other hand, in the full-state detection chamber 150, a configuration is adopted in which a developer storage portion 151 made of a transparent or semi-transparent resin which has, for example, a U-shaped cross-section and extends vertically is provided, an optical detector (not shown) such as a photo-coupler having, for example, a light-emitting element and a light receiving element disposed facing each other is disposed at a place corresponding to a predetermined full-state detecting position of the developer storage portion 151, and the optical detector detects whether developer has reached the full-state detecting position.

Further, for example, a cylindrical body 160 is provided, as a cover member, above the full-state detection chamber 150, and a communication portion 155 leading to the full-state detection chamber 150 is open-installed inside a portion of the cylindrical body 160.

The cylindrical body 160 constitutes a transport path in order for the developer G overflowing from the developer collection chamber 140 to be transported to the full-state detection chamber 150, and also serves as a member for preventing a situation in which floating toner goes directly into the full-state detection chamber 150.

More specifically, for example, when the developer G transported from the belt cleaning device 53 drops from the recovery port 115, most of the developer reach the developer collection chamber 140, but the full-state detection chamber 150 is present at a close place of a drop position from the recovery port 115, and thus there may be a concern of some toner of the developer G floating to the full-state detection chamber 140 side due to the toner being formed as a cloud. However, as described above, the communication portion 155 of the full-state detection chamber 150 is covered with the cylindrical body 160, there may be little concern of floating substances such as toner getting in directly.

Transport Member

In addition, as shown in FIG. 6, a transport member 170 is provided astride the full-state detection chamber 150 from the developer collection chamber 140, and is configured such that both ends of a rotating shaft 171 are rotatably supported by bearings 181 and 182 which are previously provided on both ends of the recovery container 130 (specifically, rear case 130*r*), a spiral blade 172 intended for transporting the developer G in the direction of arrow A in association with the rotation of a predetermined direction of the rotating shaft 171 in the vicinity of the rotating shaft 171 is formed at a predetermined pitch and with a predetermined outside diameter in a region Rs corresponding to the developer collection chamber 140, the rotating shaft 171 is further passed into the cylindrical body 160 in a region Rm of the full-state detection chamber 150, a spiral blade 173 having an outside diameter in a range falling within the inside diameter of the cylindrical body 160 is formed at a predetermined pitch in the vicinity of the rotating shaft 171 just before reaching at least the communication portion 155 of the full-state detection chamber 150 so that developer within the cylindrical body 160 is transported to the communication portion 155 side in association with the rotation of the rotating shaft 171 in a predetermined direction, and a spiral blade 174 having an outside diameter in a range falling within the inside diameter of the cylindrical body 160 is formed in the vicinity of the rotating shaft 171 located on the back side in which the communication portion 155 of the cylindrical body 160 is interposed so that the developer within the cylindrical body 160 is pressed back to the communication portion 155 side in association with the rotation of the rotating shaft in a predetermined direction. Meanwhile, bearing-receiving members (for example, D cut or large-diameter shafts), not shown, which are supported by the bearings 181 and 182 are provided on both ends of the rotating shaft 171 in FIG. 6. In the present example, a driving force from a driving motor, not shown, is transmitted to the bearing-receiving members.

Further, in the present example, the transport member 170 is used in transporting developer along a direction from the developer collection chamber 140 to the full-state detection chamber 150, but is inclined obliquely upward so that a position on the full-state detection chamber 150 side becomes higher in the transport direction of developer.

In the present example, although inclined at an angle approximately corresponding to changes in the heights of the partition walls 141 to 143 in the developer collection chamber 140, the spiral blade 172 of the transport member 170 is disposed above the partition walls 141 to 143 so as not to interfere with at least the upper ends of the partition walls 141 to 143.

Waste Toner Discharge Device

Figure 10:
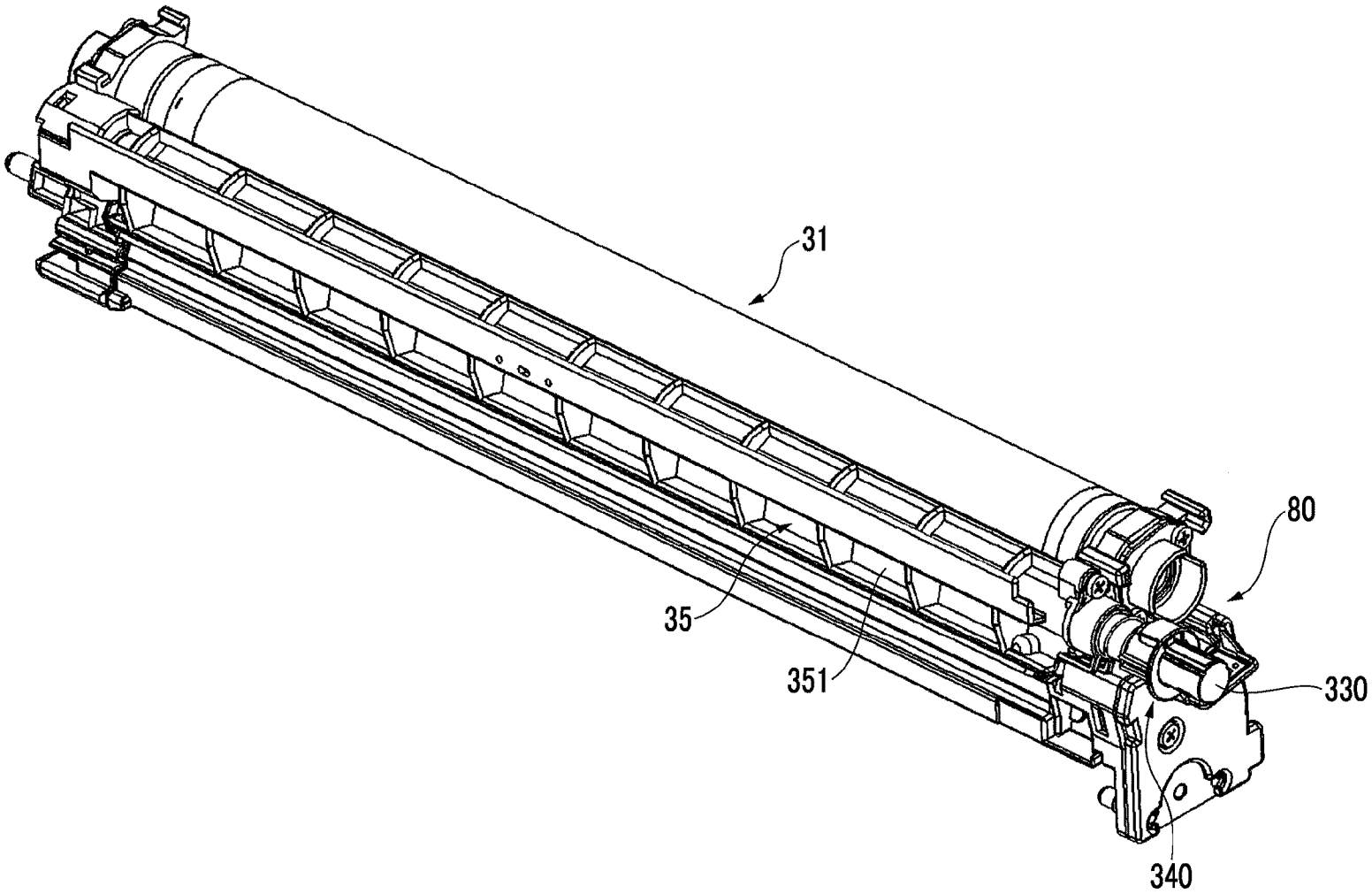
FIG. 10 is a diagram illustrating a cleaning device used in the first exemplary embodiment and a waste toner discharge device attached to the cleaning device.

In the present exemplary embodiment, as shown in FIGS. 3 and 10, the cleaning device 35 includes a cleaning container 351 extending the rotational-axis direction of the photoconductor 31, and is configured such that a transport member (not shown) capable of transporting waste toner along the rotational-axis direction of the photoconductor 31 is arranged within the cleaning container 351, and that the waste toner discharge devices 80 (81 to 84) are attached to the terminal side of the cleaning container 351 in the transport direction of the waste toner.

In the present exemplary embodiment, each of the waste toner discharge devices 80 (81 to 84) is communicatively connected to the cleaning container 351, and includes a transport duct 330 having an approximately rectangular discharge port 331 (see FIG. 11) which is open upward at the tip portion, and a shutter mechanism 340 as an opening and closing mechanism that opens and closes the discharge port 331 of the transport duct 330.

Transport Duct

Figure 11:
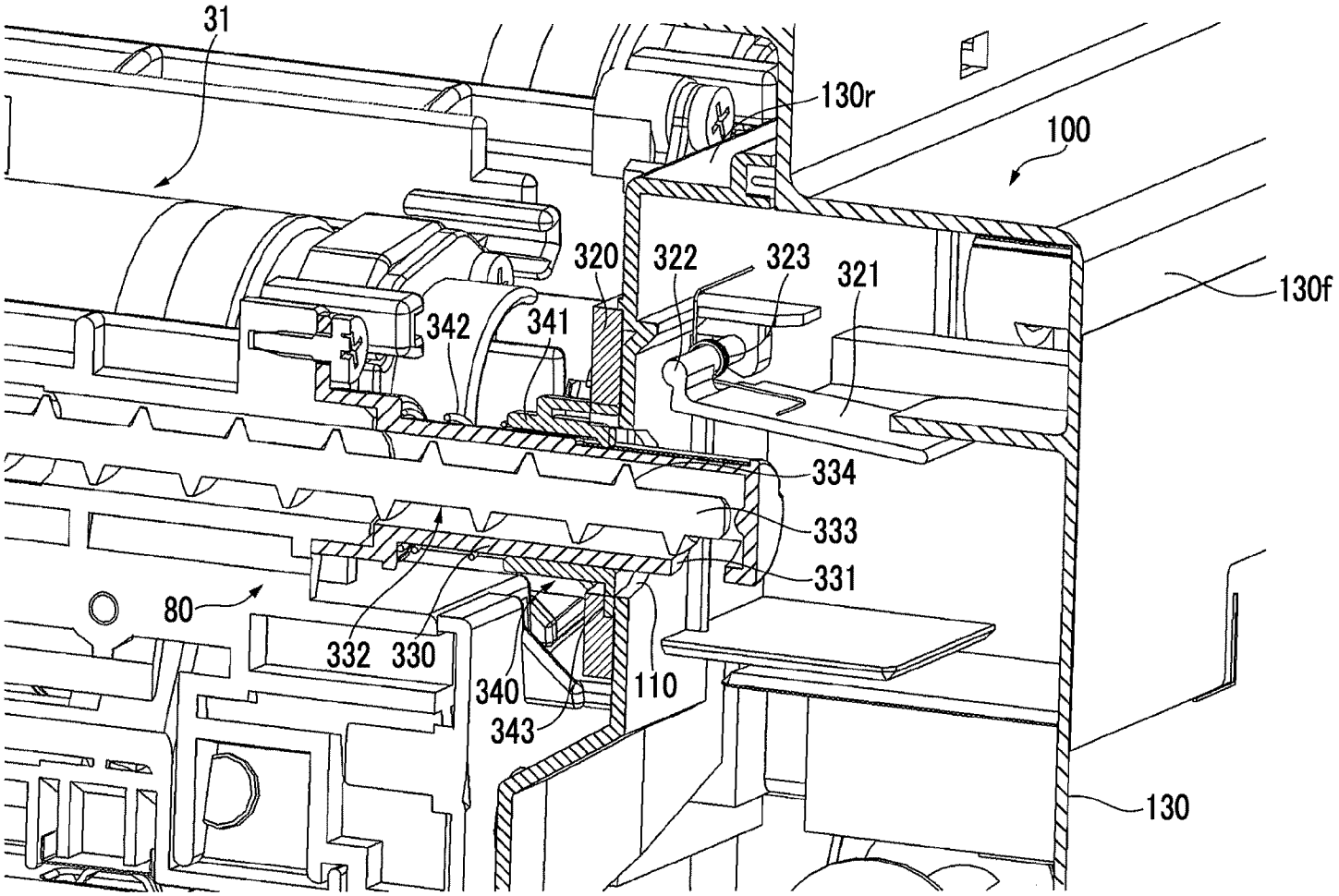
FIG. 11 is a partial cutaway view illustrating a state of connection between the waste toner discharge device attached to the cleaning device used in the first exemplary embodiment and the developer recovery device.

In the present example, as shown in FIGS. 10 and 11, the transport duct 330 is formed in an approximately cylindrical cross-sectional shape of which the tip is blocked by a resin material (for example, POM) having good sliding mobility (so-called slidability), and is configured such that a transport member 332 (in the present example, an aspect in which a spiral blade 334 is formed in the vicinity of a rotating shaft 333) which is connected coaxially integrally with a transport member (not shown) within the cleaning device 35 is provided therein.

Shutter Mechanism

As shown in FIGS. 10 and 11, the shutter mechanism 340 is fit to the outer circumferential portion of the transport duct 330 so as to be movable along the transport direction of the waste toner, and includes a shutter member 341 as a cover member constituted by a cylindrical member moving between a predetermined open position and closed position of the discharge port 331, an urging spring 342 as an urging member, provided between the shutter member 341 and a portion of the outer circumferential portion of the transport duct 330 away from the shutter member 341 in a rotation-stopped state, which urges the shutter member 341 toward the closed position of the discharge port 331, and a flange portion 343 which is integrally formed on the recovery container 130 side of the shutter member 341 constituted by a cylindrical member so as to widen in a brim shape.

Structure of Connection with Waste Toner Discharge Device

Figure 8:
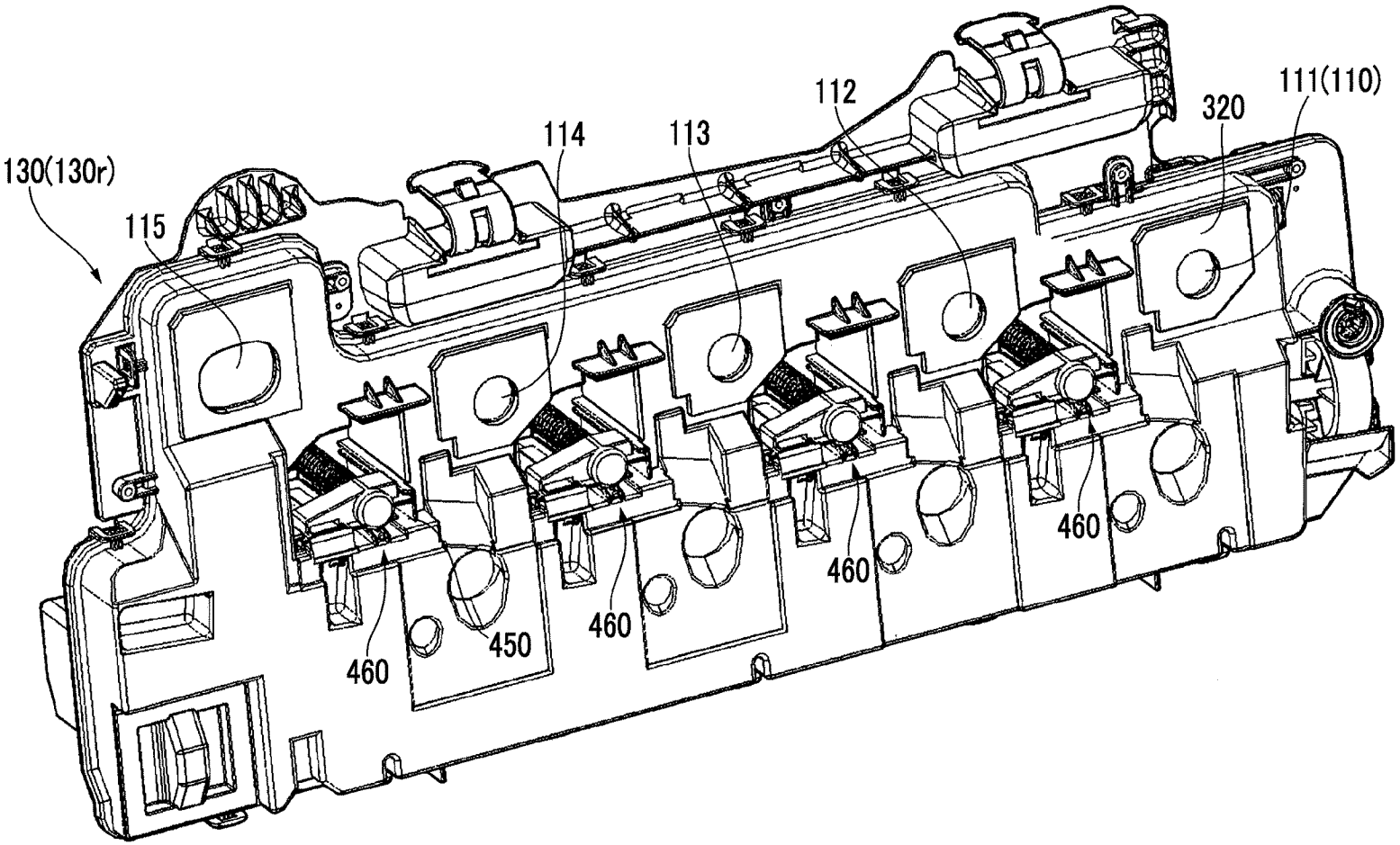
FIG. 8 is a perspective view when the recovery container of the developer recovery device used in the first exemplary embodiment is viewed from the rear side.
Figure 9:
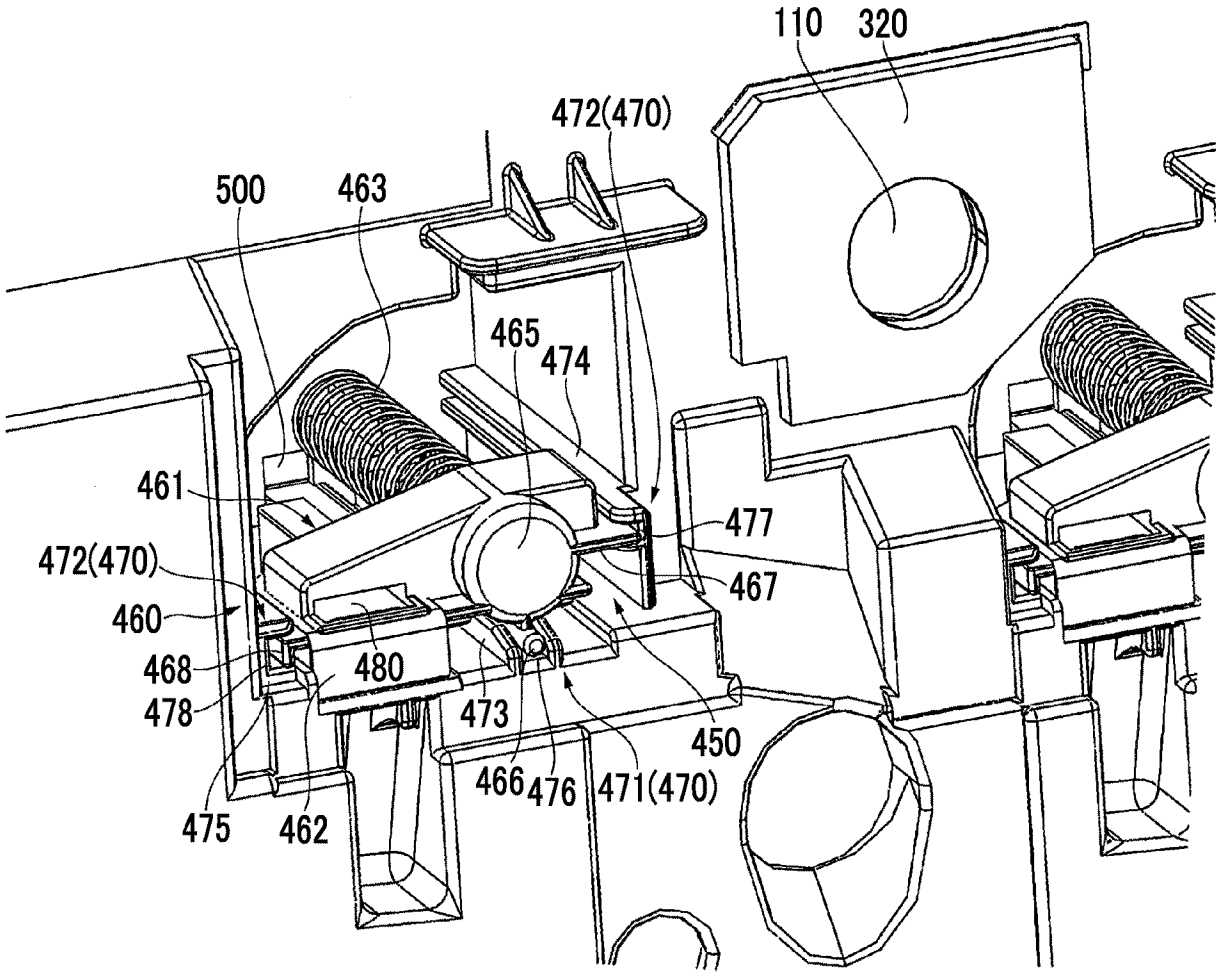
FIG. 9 is a diagram illustrating main parts of a recovery port structure of the recovery container used in the first exemplary embodiment.

In the present exemplary embodiment, as shown in FIGS. 8, 9 and 11, the recovery ports 110 (specifically, 111 to 114) of the recovery container 130 are constituted by circular holes having an outside diameter slightly larger than the outside diameter of the transport duct 330, and is configured such that when the tip portion of the transport duct 330 is inserted into the recovery port 110, the flange portion 343 of the shutter member 341 blocked at the recovery port 110 edge only the tip portion of the transport duct 330 is inserted into the recovery port 110 of the recovery container 130, and that the discharge port 331 formed at the tip portion of the transport duct 330 is disposed within the recovery port 110. That is, in the present example, the flange portion 343 of the shutter member 341 functions as a movable member that relatively moves the shutter member 341 with respect to the transport duct 330 until reaching the open position of the discharge port 331.

Further, in the present exemplary embodiment, a seal member 320 as an air-tightness holding member using an urethane rubber or the like is provided on the outer circumferential edge of the recovery port 110 of the recovery container 130. For example, when the flange portion 343 of the shutter member 341 comes into contact with the seal member 320 on the recovery port 110 edge, air-tightness between the flange portion 343 and the recovery port 110 edge is maintained. In addition, a sealing member 321 made of an elastic film material is provided inside the recovery port 110 of the recovery container 130 so as to be rotatable using the upper edge as a rotation fulcrum 322. In a state where the tip portion of the transport duct 330 is not inserted into the recovery port 110, the sealing member 321 is disposed at a position where the recovery port 110 is blocked by an urging spring 323 mounted on the rotation fulcrum 322.

Meanwhile, the recovery port 115 to which the waste toner discharge device 85 is connected is provided with a similar seal member or sealing member.

Waste Developer Discharge Device

Figure 12:
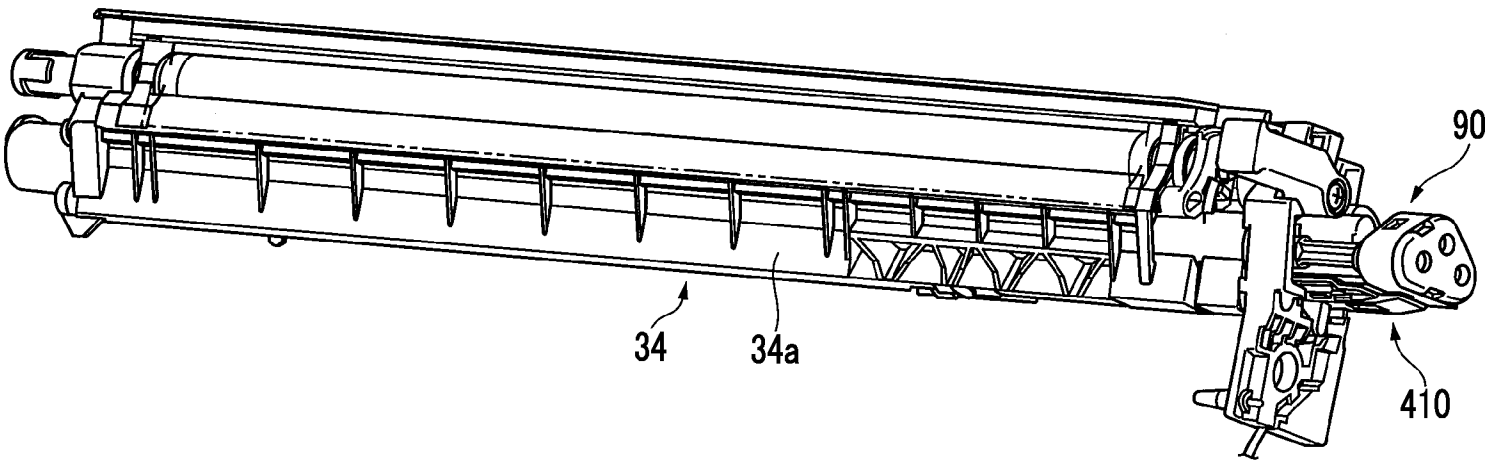
FIG. 12 is a diagram illustrating a developing device used in the first exemplary embodiment and a waste developer discharge device attached to the developing device.
Figure 13:
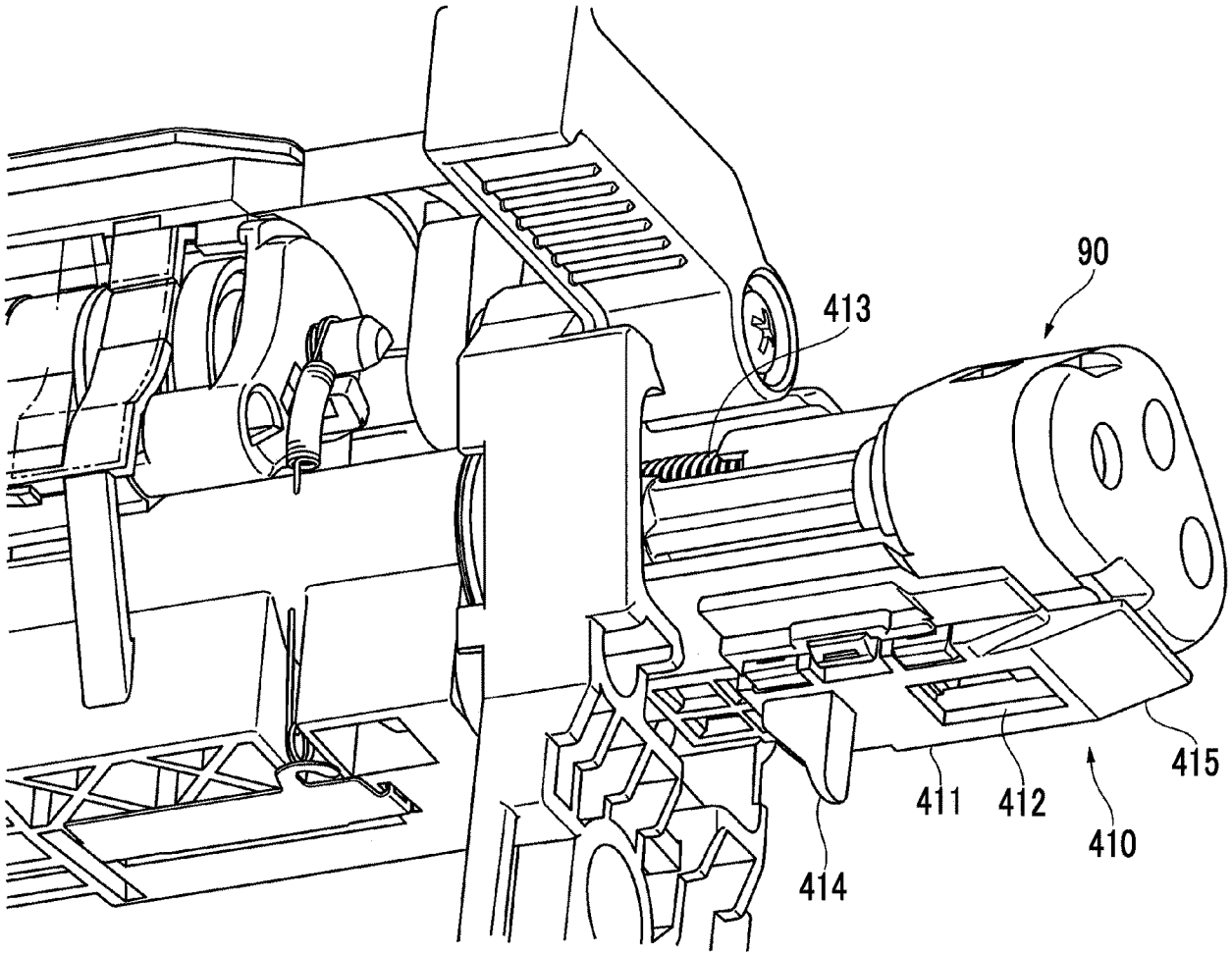
FIG. 13 is a diagram illustrating main parts of the waste developer discharge device attached to the developing device used in the first exemplary embodiment.

In the present exemplary embodiment, as shown in FIGS. 5, 12 and 13, the developing device 34 includes a developing container 34*a* extending in the rotational-axis direction of the photoconductor 31, and includes developing elements such as a developing roll, a stirring transport member that stirs and transports developer, and the like within the developing container 34*a*. The developing device is configured such that the waste developer discharge devices 90 (specifically, 91 to 94) are attached to one end side of the developing container 34*a* in a longitudinal direction, and that the waste developer is discharged periodically.

Figure 15:
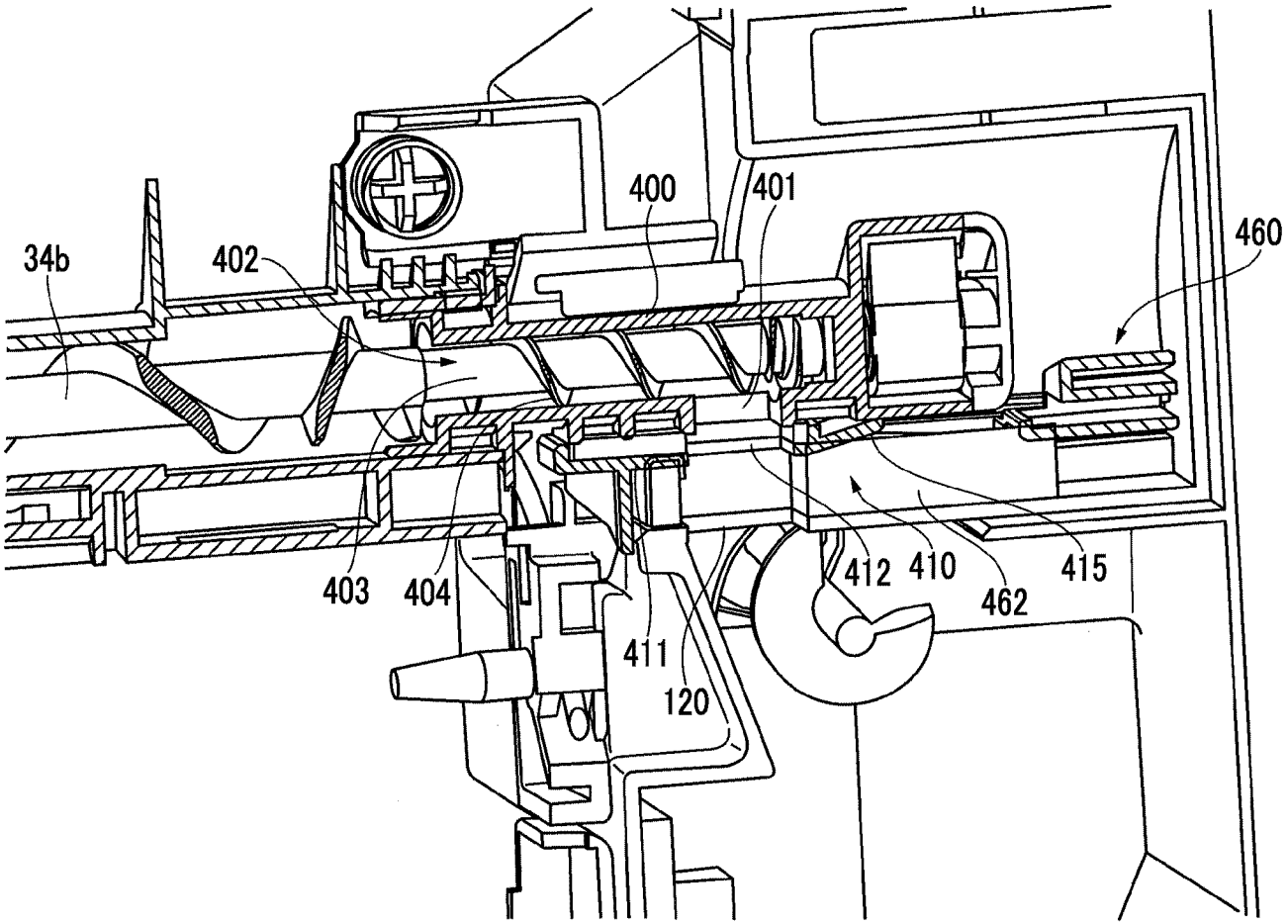
FIG. 15 is a partial cutaway view illustrating a state of connection between the waste developer discharge device attached to the developing device used in the first exemplary embodiment and the developer recovery device.

In the present exemplary embodiment, the waste developer discharge device 90 is communicatively connected to the developing container 34*a* as shown in FIGS. 12 and 13, and includes a transport duct 400 having an approximately rectangular discharge port 401 which is open upward, as shown in FIG. 15, at the tip portion, and a shutter mechanism 410 as an opening and closing mechanism, provided below the discharge port 401 of the transport duct 400, which opens and closes the discharge port 401.

Transport Duct

In the present exemplary embodiment, as shown in FIGS. 12 and 15, the transport duct 400 is configured such that a transport member 402 (in the present example, an aspect in which a spiral blade 404 is formed in the vicinity of a rotating shaft 403) which is connected coaxially integrally with a stirring transport member 34*b* of developer is provided, and that old developer overflowing from inside of the developing container 34*a* into the transport duct 400 is transported up to the discharge port 401 by the transport member 402.

Shutter Mechanism

In the present exemplary embodiment, the shutter mechanism 410 is configured such that a plate-shaped shutter member 411 as a cover member is held so as to freely move back and forth along the longitudinal direction of the transport duct 400, a communication portion 412 corresponding to the discharge port 401 of the transport duct 400 is open-installed in the shutter member 411, an urging spring 413 for urging the shutter member 411 is further installed within the transport duct 400, and that an urging force of the urging spring 413 is transmitted to the shutter member 411 through a transmission block 414.

In the present example, when the waste developer discharge device 90 is in a state of non-connection to the developer recovery device 100, the shutter member 411 is urged by the urging spring 413, and is stopped at a closed position where the discharge port 401 is closed.

Further, in the present example, a connection piece 415 is integrally formed at the tip of the shutter member 411 so as to protrude.

Shutter Mechanism of Recovery Container Side

Figure 14:
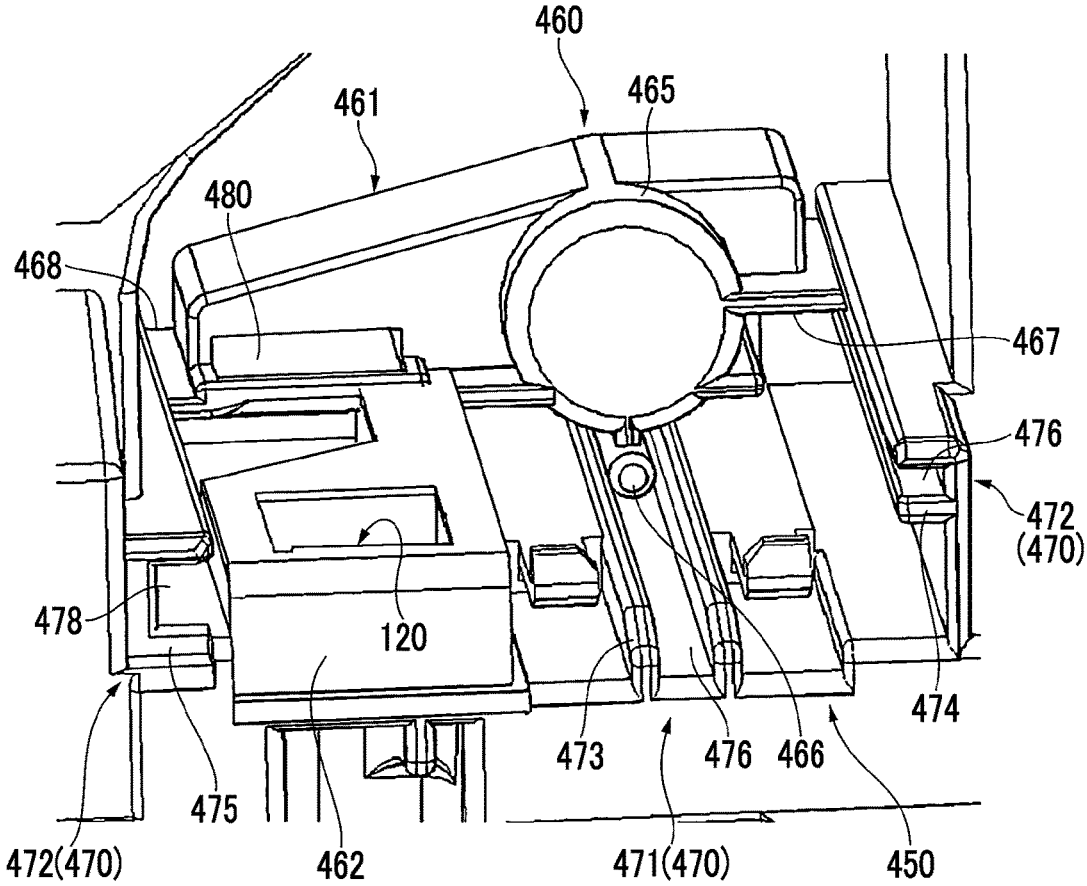
FIG. 14 is a diagram illustrating main parts of a recovery port structure that recovers waste developer which is discharged from the waste developer discharge device used in the first exemplary embodiment.

In the present exemplary embodiment, as shown in FIGS. 8, 9 and 14, the recovery container 130 includes a recess 450 into which the tip of each of the waste developer discharge devices 90 (specifically, 91 to 94) is inserted, and is configured such that the recovery port 120 (specifically, 121 to 124) is open-installed at the bottom of the recess 450, and a shutter mechanism 460 is installed in the vicinity of the recovery port 120.

In the present exemplary embodiment, the shutter mechanism 460 includes a shutter member 461 as a cover member which advances and retreats in a front-back direction directed to the back side from the front side of the recess 450 of the recovery container 130, and is configured such that a seal member 462 made of an elastic member such as urethane rubber is fixed to the circumference of the recovery port 120 edge, and that the recovery port 120 edge and the shutter member 461 are sealed by the seal member 462 when the shutter member 461 is located at a closed position where the recovery port 120 is closed.

In addition, an urging spring 463 is provided on the back side of the recess 450, and the shutter member 461 is urged by the urging spring 463 toward the closed position where the recovery port 120 is closed.

Further, in the present exemplary embodiment, the shutter member 461 includes a shutter block 465 of a region at which the recovery port 120 of the recess 450 is blocked and a region adjacent thereto which extends in a width direction intersecting the front-back direction of the recess 450, and is configured such that a guided rod 466 protruding downward and extending in the front-back direction of the shutter member 461 is integrally formed at the bottom of the shutter block 465, and that guided pieces 467 and 468 are formed on both sides of the shutter block 465 in a width direction so as to be projected outside.

Further, in the present exemplary embodiment, the recess 450 is provided with a guide mechanism 470 that guides an opening and closing operation of the shutter member 461. The guide mechanism 470 includes a first guide portion 471, provided at the bottom of the recess 450, which slidably guides the guided rod 466, and a second guide portion 472, provided on both sidewalls of the recess 450, which slidably guides the guided pieces 467 and 468.

Particularly, in the present example, the first guide portion 471 is configured such that a recessed groove 476 is formed between a pair of guide rails 473 lined up in the width direction of the recess 450, and that the guided rod 466 is guided along the direction of a guide rail 474 using both lateral sides of the recessed groove 476 as position regulation surfaces for regulating the position of the guided rod 466 in a width direction.

The second guide portion 472 is configured such that recessed grooves 477 and 478 are formed between a pair of guide rails 474 and 475 lined up in the vertical direction of the recess 450, and that the guided pieces 467 and 468 are guided along the direction of the guide rails 474 and 475 using upper and lower surfaces of the recessed grooves 477 and 478 as regulation surfaces for regulating the positions of the guided pieces 467 and 468 in a vertical direction.

Further, in the present exemplary embodiment, a connection hole 480 capable of being connected to the connection piece 415 of the shutter mechanism 410 of the waste developer discharge device 90 is open-installed in the shutter block 465 of the shutter member 461.

Structure of Connection with Waste Developer Discharge Device

In the present exemplary embodiment, as shown in FIG. 5, when the recovery container 130 of the developer recovery device 100 is gradually directed to a rising posture during the incorporation of the developer recovery device 100 into the device housing 21, the shutter mechanism 460 on the recovery container 130 side is engaged with the shutter mechanism 410 on the waste developer discharge device 90 side.

In this case, when the connection piece 415 of the shutter mechanism 410 on the waste developer discharge device 90 side is fitted into the connection hole 480 of the shutter mechanism 460 on the recovery container 130 side, and then the recovery container 130 rises and moves, the shutter member 461 of the shutter mechanism 460 retreats to the back side within the recess 450 against the urging force of the urging spring 463, and is stopped at a step of reaching the open position of the recovery port 120. In this state, the shutter member 411 of the shutter mechanism 410 retreats against the urging force of the urging spring 413, the communication portion 412 of the shutter member 411 moves to a position coinciding with the discharge port 401 of the transport duct 400, and the shutter member 411 reaches an open position where the discharge port 401 is opened.

In this state, the discharge port 401 of the waste developer discharge device 90 communicates with the recovery port 120 of the shutter mechanism 460 on the recovery container 130 side, the state of connection between the both is completed.

As a result, the waste developer transported by the transport member 402 within the transport duct 400 of the waste developer discharge device 90 is discharged from the discharge port 401 and is recovered into the recovery container 130 through the recovery port 120.

In addition, the seal member 462 is interposed between the discharge port 401 of the waste developer discharge device 90 and the recovery port 120 of the recovery container 130, and thus air-tightness between the both is maintained.

Air Vent Structure of Recovery Container

In the present exemplary embodiment, the used developer (waste toner, waste developer) is recovered to the recovery container 130 of the developer recovery device 100, but the internal pressure of the recovery container 130 increases with the recovery of the developer, and thus there may be a concern that developer (mainly, waste toner) floating in a cloud shape within the recovery container 130 flows back from the recovery ports 110 (111 to 114), 115 and 120 (121 to 124) in association therewith.

In this case, since the peripheries of the recovery ports 110 and 120 are covered with the seal members 320 and 462, the waste toner is effectively prevented from leaking from the peripheries of the recovery ports 110 and 120, but there may be a concern of the waste toner being mixed and attached to a gap between the shutter members of the shutter mechanisms 340, 410 and 460. Thereby, sliding resistance associated with opening and closing operations of the shutter member increases due to the mixing of the waste toner, and thus there may be a concern of acting as a factor for defective opening and closing operations of the shutter members.

Consequently, from the viewpoint of avoiding such a situation, the following air vent structure is adopted in the recovery container 130 in the present exemplary embodiment.

Figure 16:
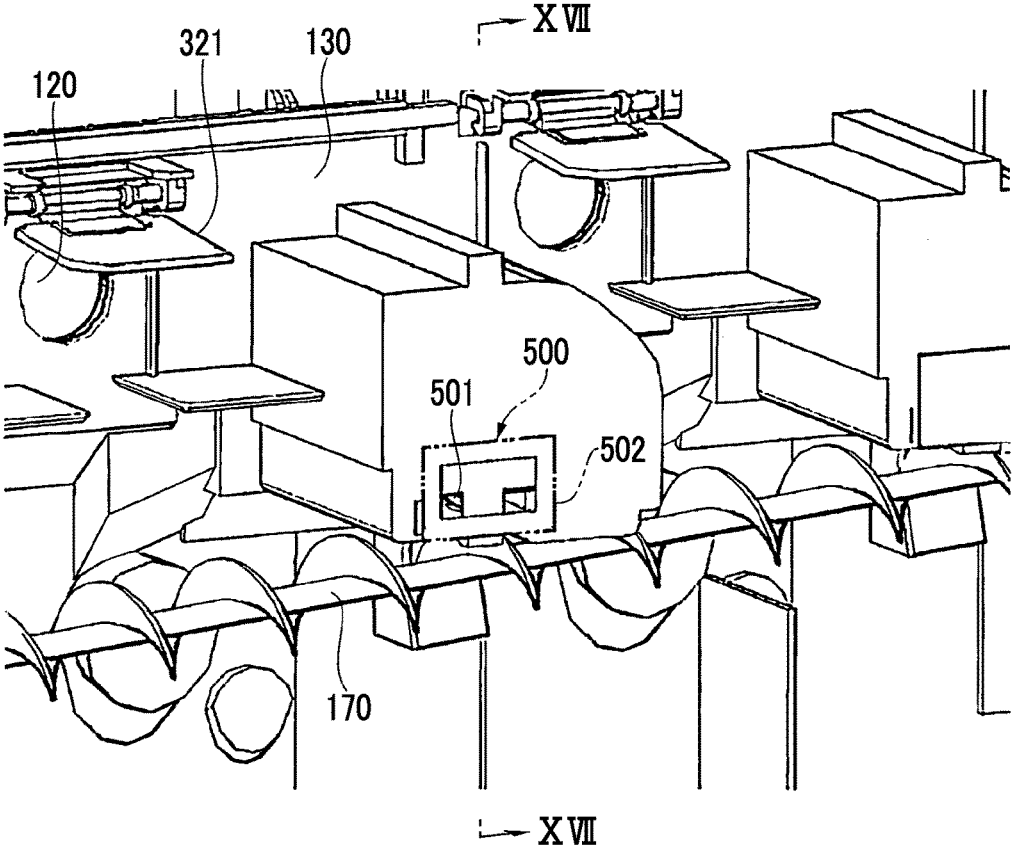
FIG. 16 is a diagram illustrating main parts of an air vent structure used in the first exemplary embodiment.
Figure 17:
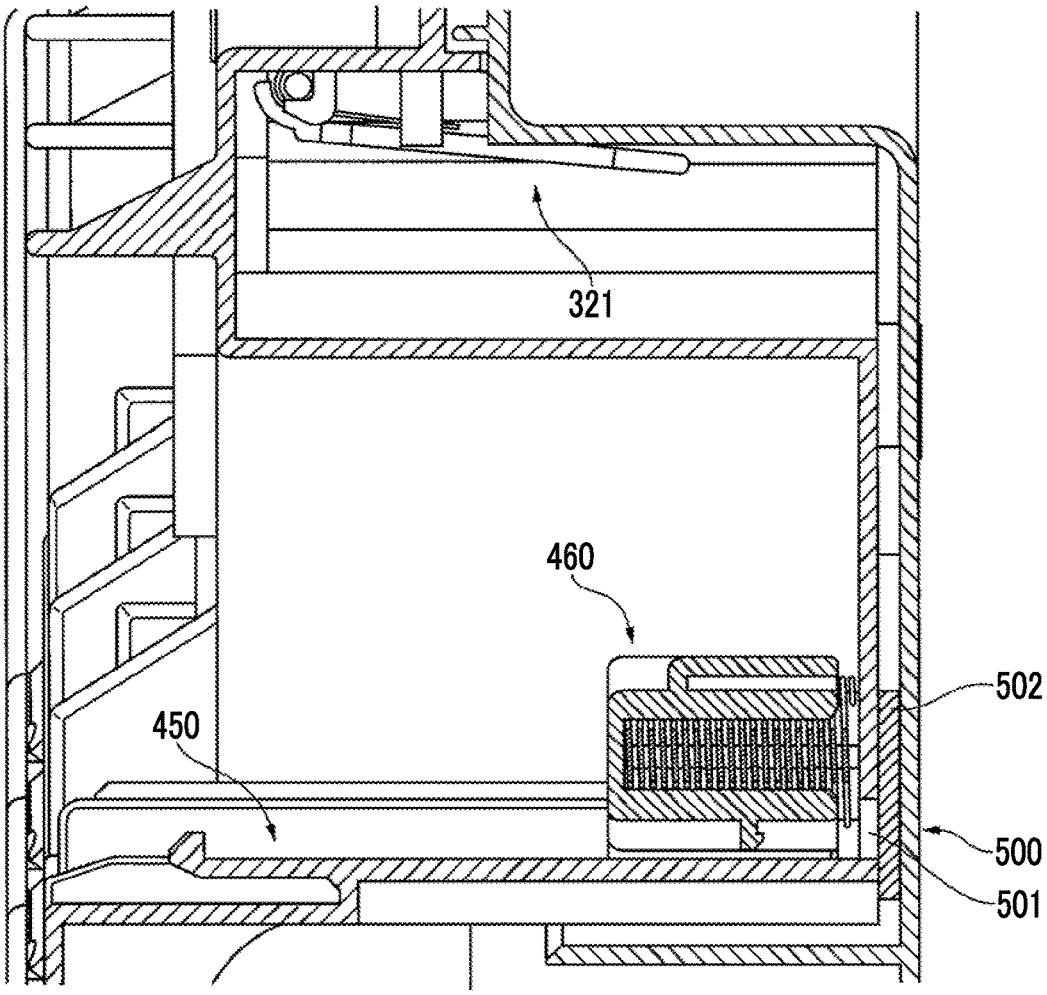
FIG. 17 is a cross-sectional diagram taken along line XVII-XVII of FIG. 16.

In the present exemplary embodiment, as shown in FIGS. 9, 16 and 17, an air vent port 500 is provided on the back side of the recess 450 which is a connecting portion with the waste developer discharge device 90 (specifically, 91 to 94) in the recovery container 130.

Configuration Example of Air Vent Port

The air vent port 500 is configured such that one or plural (two in the present example) openings 501 are open-installed at the vertical-wall portion of the recovery container 130 on the back side of the recess 450, and that the openings 501 are covered with an air-permeable filter member 502 that captures the waste toner on the inner side of the recovery container 130.

In the present example, since the filter member 502 of the air vent port 500 captures the waste toner, only the air is vented from the air vent port 500, and an increase in the internal pressure of the recovery container 130 is suppressed.

Figure 18:
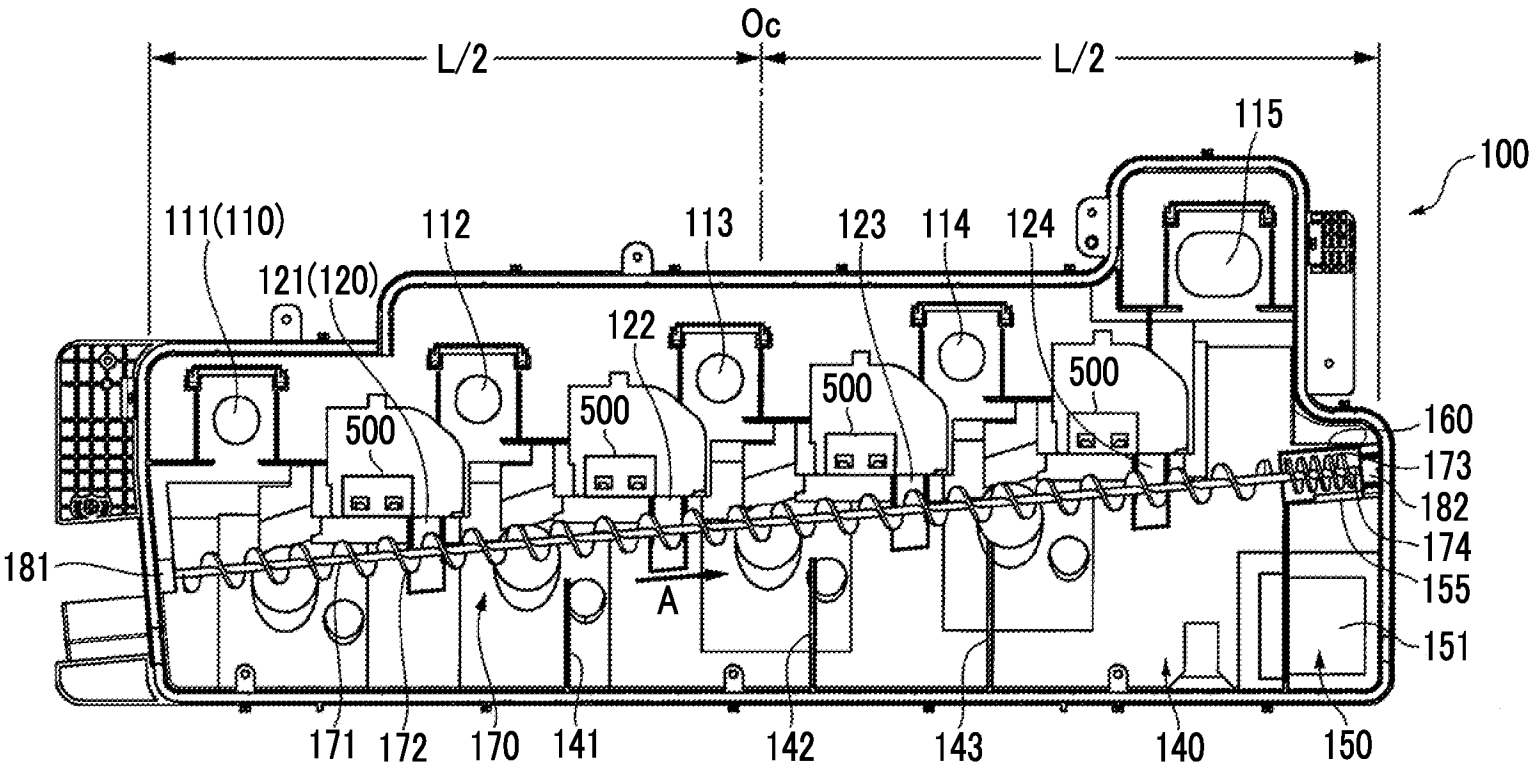
FIG. 18 is a diagram illustrating a layout of air vent ports used in the first exemplary embodiment.

Layout of Air Vent Ports (1) Layout of Recovery Container in Longitudinal Direction In the present exemplary embodiment, as shown in FIG. 18, the air vent ports 500 are respectively provided on the back sides of four recesses 450 in the recovery container 130.

When the dimension of the recovery container 130 in a longitudinal direction is set to L, these air vent ports 500 are separately provided at regions with the center Oc in the longitudinal direction of the recovery container 130 interposed therebetween so as to be the same as each other in number (two in the present example). Therefore, an increase in the internal pressure of the recovery container 130 is suppressed approximately equally throughout the entire area. A difference in internal pressure is not conspicuously exhibited between regions with the center Oc in the longitudinal direction of the recovery container 130 interposed therebetween, and a case also does not occur in which an airflow is unnecessarily generated due to a difference in internal pressure within the recovery container 130.

(2) Lower-Limit Requirement of Layout of Air Vent Ports

In the present exemplary embodiment, the air vent port 500 is provided further vertically upward than the arrangement position of the transport member 170. In the present example, since the developer collected within the developer collection chamber 140 is evenly transported to the transport member 170, the maximum amount of developer collected falls within to the arrangement position of the transport member 170. Thus, in the present example, since developer is not collected up to a region facing the air vent port 500, there may be no concern of the air vent port 500 being embedded by developer and thus being clogged.

(3) Positional Relationship Between Air Vent Port and Recovery Port

In the present exemplary embodiment, the air vent port 500 is provided at a region which does not face a drop path of developer recovered from the recovery ports 110, 115, and 120. Therefore, there may be little concern that developer dropping from the recovery ports 110, 115, and 120 infiltrates directly to the air vent port 500.

(4) Upper-Limit Requirement of Layout of Air Vent Ports

In the present exemplary embodiment, as shown in FIG. 18, the air vent ports 500 are disposed further vertically downward than the recovery ports 110 (specifically, 111 to 114) and 115 to which the waste toner discharge devices 80 (specifically, 81 to 84) are connected.

For this reason, developer (mainly, waste toner) within the recovery container 130 moves on an airflow directed to the air vent port 500 as a cloud due to an increase in internal pressure, but the recovery port 110 is not present in the passing region of this airflow, and thus a concern of the developer within the recovery container 130 being attached to the recovery ports 110 and 115 is suppressed. Meanwhile, in the present exemplary embodiment, the air vent port 500 adjacent to the recovery port 114 is not provided further vertically downward than the recovery port 111, but an airflow flowing to the air vent port 500 adjacent to the recovery port 114 does not influence the recovery port 111, which does not lead to any trouble.

In addition, in the present exemplary embodiment, as shown in FIG. 18, the air vent ports 500 are not provided further vertically downward than the recovery ports 120 (specifically, 121 to 124) to which the waste developer discharge devices 90 (specifically, 91 to 94) are connected. However, unlike the recovery ports 110 and 115 with respect to the waste toner discharge device 80 (specifically, 81 to 84) from the cleaning device 35 of each image forming portion 22 and the waste toner discharge device 85 from the belt cleaning device 53 of the intermediate transfer belt 230, the waste developer discharge device 90 (specifically, 91 to 94) from the developing device 34 of each image forming portion 22 is configured not to infiltrate into the recovery container 130 through the recovery port 120. Therefore, there may be little concern of the contamination of the recovery port 120 due to a cloud of powder. Thus, there is no problem even when the air vent port 500 is provided further upward than the recovery port 120. Meanwhile, there may be a concern of a back flow from the recovery ports 110, 115, and 120 due to an increase in internal pressure within the recovery container 130, but an increase in internal pressure is effectively suppressed by the effect of the air vent port 500.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A powder recovery device comprising:

a recovery container that includes a powder collection chamber therein, recovers used powder transported from a powder processing section that performs a process using powder, and collects the recovered powder in the powder collection chamber; and a transport member that is provided within the recovery container along the longitudinal direction of the recovery container, and evenly transports powder collected in the powder collection chamber, wherein a plurality of recovery ports are provided at positions located higher than a highest location in the recovery container at which powder is collected, and recover the used powder transported from the powder processing section, and a plurality of air vent ports are at least separately provided at regions with a center of the recovery container in the longitudinal direction of the recovery container interposed therebetween, are located higher than the transport member, and are installed at positions deviating from drop paths of powder from the respective recovery ports and at regions which do not exceed a vertical lower-end position of a proximal recovery port.

2. The powder recovery device according to claim 1, wherein a number of the plurality of air vent ports is equal to or less than a number of recovery ports lined up in longitudinal direction of the recovery container.

3. The powder recovery device according to claim 1, wherein the plurality of air vent ports are disposed at regions with the center in the longitudinal direction of the recovery container interposed therebetween so as to be the same as each other in number.

4. The powder recovery device according to claim 1, wherein the plurality of air vent ports are disposed so as to be displaced from the installed positions of the recovery ports in a width direction intersecting the longitudinal direction of the recovery container.

5. The powder recovery device according to claim 1, wherein each air vent port includes an opening in a portion of the recovery container, and the opening is covered with an air-permeable filter member capable of capturing powder.

6. The powder recovery device according to claim 1, wherein the recovery port is connected with a powder discharge portion that discharges powder transported from the powder processing section, and is sealed by an openable and closable sealing member during non-connection of the powder discharge portion.

7. A processing device comprising:

a powder processing section that performs a process using powder; and the powder recovery device according to claim 1 that recovers powder transported from the powder processing section.

8. A processing device comprising:

a powder processing section that performs a process using powder; and the powder recovery device according to claim 2 that recovers powder transported from the powder processing section.

9. The processing device according to claim 7, wherein the powder processing section includes an image holding member capable of holding an electrostatic latent image, a developing device that develops an electrostatic latent image formed on the image holding member with developer as powder, a transfer device that transfers a visible image developed by the developing device to a recording material, and a cleaning device that cleans developer remaining on the image holding member, and the powder recovery device recovers developer as powder transported from at least one of the cleaning device, the transfer device and the developing device.

10. The processing device according to claim 8, wherein the powder processing section includes an image holding member capable of holding an electrostatic latent image, a developing device that develops an electrostatic latent image formed on the image holding member with developer as powder, a transfer device that transfers a visible image developed by the developing device to a recording material, and a cleaning device that cleans developer remaining on the image holding member, and the powder recovery device recovers developer as powder transported from at least one of the cleaning device, the transfer device and the developing device.

11. The processing device according to claim 9, wherein the air vent port is disposed further vertically downward than a recovery port of powder transported from the cleaning device.

12. The processing device according to claim 10, wherein the air vent port is disposed further vertically downward than a recovery port of powder transported from the cleaning device.

13. A powder recovery device comprising:

a recovery container that includes a powder collection chamber therein, recovers used powder transported from a powder processing section that performs a process using powder, and collects the recovered powder in the powder collection chamber; and a transport member that is provided within the recovery container along the longitudinal direction of the recovery container, and evenly transports powder collected in the powder collection chamber, wherein a plurality of recovery ports are provided at positions located higher than the transport member, and recover the used powder transported from the powder processing section, and a plurality of air vent ports are at least separately provided at regions with a center of the recovery container in the longitudinal direction of the recovery container interposed therebetween, are located higher than the transport member, and are installed at positions deviating from drop paths of powder from the respective recovery ports and at regions which do not exceed a vertical lower-end position of a proximal recovery port.

14. The powder recovery device according to claim 13, wherein a number of the plurality of air vent ports is equal to or less than a number of recovery ports lined up in longitudinal direction of the recovery container.

15. The powder recovery device according to claim 13, wherein the plurality of air vent ports are disposed at regions with the center in the longitudinal direction of the recovery container interposed therebetween so as to be the same as each other in number.

16. The powder recovery device according to claim 13, wherein the plurality of air vent ports are disposed so as to be displaced from the installed positions of the recovery ports in a width direction intersecting the longitudinal direction of the recovery container.

17. The powder recovery device according to claim 13, wherein each air vent port includes an opening in a portion of the recovery container, and the opening is covered with an air-permeable filter member capable of capturing powder.

18. The powder recovery device according to claim 13, wherein the recovery port is connected with a powder discharge portion that discharges powder transported from the powder processing section, and is sealed by an openable and closable sealing member during non-connection of the powder discharge portion.

19. A processing device comprising:

a powder processing section that performs a process using powder; and the powder recovery device according to claim 13 that recovers powder transported from the powder processing section.

20. A processing device comprising:

a powder processing section that performs a process using powder; and the powder recovery device according to claim 14 that recovers powder transported from the powder processing section.

* * * * *